US006910423B2

(12) United States Patent
Lloyd

(10) Patent No.: US 6,910,423 B2
(45) Date of Patent: Jun. 28, 2005

(54) KINETIC ENERGY ROD WARHEAD WITH LOWER DEPLOYMENT ANGLES

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 29 days.

(21) Appl. No.: 10/456,777

(22) Filed: Jun. 6, 2003

(65) Prior Publication Data

US 2004/0200380 A1 Oct. 14, 2004

Related U.S. Application Data

(63) Continuation-in-part of application No. 09/938,022, filed on Aug. 23, 2001, now Pat. No. 6,598,534.

(51) Int. Cl.[7] ..... F42B 12/32
(52) U.S. Cl. ..... 102/497; 102/476; 102/494
(58) Field of Search ..... 102/473–476, 102/491–497

(56) References Cited

U.S. PATENT DOCUMENTS

| | | | |
|---|---|---|---|
| 1,198,035 | A | 9/1916 | Huntington |
| 1,229,421 | A | 6/1917 | Downs |
| 1,235,076 | A | 7/1917 | Stanton |
| 1,244,046 | A | 10/1917 | Ffrench |
| 1,300,333 | A | 4/1919 | Berry |
| 1,305,967 | A | 6/1919 | Hawks |
| 2,296,980 | A | 9/1942 | Carmichael |

(Continued)

FOREIGN PATENT DOCUMENTS

| | | |
|---|---|---|
| DE | 3327043 A1 | 2/1985 |
| DE | 38 30 527 A1 | 3/1990 |
| EP | 270 401 A1 | 6/1988 |
| FR | 2 678 723 | 1/1993 |
| GB | 550001 | 12/1942 |
| WO | WO 97/27447 | 7/1997 |

OTHER PUBLICATIONS

Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99–197.

Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311–406.

U.S. Appl. No. 10/162,498, filed Jun. 4, 2002, Lloyd.

(Continued)

*Primary Examiner*—Michael J. Carone
*Assistant Examiner*—Troy Chambers
(74) *Attorney, Agent, or Firm*—Iandiorio & Teska

(57) ABSTRACT

A kinetic energy rod warhead including a projectile core including a plurality of individual projectiles, an explosive charge about the core, at least one detonator for the explosive charge, and structure for reducing the deployment angles of the projectiles when the detonator detonates the explosive charge.

92 Claims, 26 Drawing Sheets

U.S. PATENT DOCUMENTS

| | | | | | |
|---|---|---|---|---|---|
| 2,925,965 | A | * | 2/1960 | Pierce | 89/135 |
| 2,988,994 | A | | 6/1961 | Fleischer, Jr. et al. | |
| 3,565,009 | A | | 2/1971 | Allred et al. | |
| 3,656,433 | A | | 4/1972 | Thrailkill et al. | |
| 3,757,694 | A | | 9/1973 | Talley et al. | |
| 3,771,455 | A | | 11/1973 | Haas | |
| 3,797,359 | A | | 3/1974 | Mawhinney et al. | |
| 3,877,376 | A | | 4/1975 | Kupelian | |
| 3,941,059 | A | | 3/1976 | Cobb | |
| 3,949,674 | A | | 4/1976 | Talley | |
| 3,954,060 | A | | 5/1976 | Haag et al. | |
| 3,977,330 | A | | 8/1976 | Held | |
| 4,026,213 | A | | 5/1977 | Kempton | |
| 4,036,140 | A | | 7/1977 | Korr et al. | |
| 4,089,267 | A | | 5/1978 | Mescall et al. | |
| 4,106,410 | A | | 8/1978 | Borcher et al. | |
| 4,210,082 | A | | 7/1980 | Brothers | |
| 4,211,169 | A | | 7/1980 | Brothers | |
| 4,289,073 | A | * | 9/1981 | Romer et al. | 102/476 |
| 4,376,901 | A | | 3/1983 | Pettibone et al. | |
| 4,430,941 | A | | 2/1984 | Raech, Jr. et al. | |
| 4,516,501 | A | * | 5/1985 | Held et al. | 102/496 |
| 4,638,737 | A | | 1/1987 | McIngvale | |
| 4,655,139 | A | | 4/1987 | Wilhelm | |
| 4,658,727 | A | | 4/1987 | Wilhelm et al. | |
| 4,745,864 | A | | 5/1988 | Craddock | |
| 4,770,101 | A | | 9/1988 | Robertson et al. | |
| 4,848,239 | A | | 7/1989 | Wilhelm | |
| 4,922,826 | A | | 5/1990 | Busch et al. | |
| 4,996,923 | A | | 3/1991 | Theising | |
| H1047 | H | | 5/1992 | Henderson et al. | |
| H1048 | H | | 5/1992 | Wilson et al. | |
| 5,229,542 | A | | 7/1993 | Bryan et al. | |
| 5,370,053 | A | | 12/1994 | Williams et al. | |
| 5,542,354 | A | | 8/1996 | Sigler | |
| 5,544,589 | A | | 8/1996 | Held | |
| 5,578,783 | A | | 11/1996 | Brandeis | |
| 5,670,735 | A | | 9/1997 | Ortmann et al. | |
| 5,691,502 | A | | 11/1997 | Craddock et al. | |
| 5,796,031 | A | | 8/1998 | Sigler | |
| 5,823,469 | A | | 10/1998 | Arkhangelsky et al. | |
| 6,044,765 | A | | 4/2000 | Regebro | |
| 6,186,070 | B1 | | 2/2001 | Fong et al. | |
| 6,598,534 | B2 | | 7/2003 | Lloyd et al. | |
| 6,622,632 | B1 | | 9/2003 | Spivak | |
| 2003/0019386 | A1 | | 1/2003 | Lloyd et al. | |
| 2004/0011238 | A1 | | 1/2004 | Ronn et al. | |

OTHER PUBLICATIONS

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193–251.

Richard M. Lloyd, "Aligned Rod Lethality Enhanced Concept for Kill Vehicles", 10th AIAA/BMDD Technology Conf., Jul. 23–26, Williamsburg, Virginia, 2001, pp. 1–12.

U.S. Appl. No. 10/301,302, filed Nov. 21, 2002, Lloyd.

U.S. Appl. No. 10/301,420, filed Nov. 21, 2002, Lloyd.

U.S. Appl. No. 10/384,804, filed Mar. 10, 2003, Lloyd.

U.S. Appl. No. 10/385,319, filed Mar. 10, 2003, Lloyd.

U.S. Appl. No. 10/370,892, filed Feb. 20, 2003, Lloyd.

U.S. Appl. No. 10/456,391, filed Jun. 5, 2003, Lloyd et al.

U.S. Appl. No. 10/456,777, filed Jun. 6, 2003, Lloyd.

U.S. Appl. No. 10/698,500, filed Oct. 31, 2003, Lloyd.

U.S. Appl. No. 10/685,242, filed Oct. 14, 2003, Lloyd.

* cited by examiner

KINETIC ENERGY ROD WARHEAD WITH LOWER DEPLOYMENT ANGLES

RELATED APPLICATIONS

This application is a Continuation-in-Part application of U.S. patent application Ser. No. 09/938,022, filed Aug. 23, 2001 now U.S. Pat. No. 6,598,534.

FIELD OF THE INVENTION

This invention relates to improvements in kinetic energy rod warheads.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads. "Hit-to-kill" vehicles are typically launched into a position proximate a re-entry vehicle or other target via a missile such as the Patriot, THAAD or a standard Block IV missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the target and, again, biological bomblets and/or chemical submunition payloads survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook, proposes a kinetic energy rod warhead.

The two primary advantages of a kinetic energy rod warheads is that 1) it does not rely on precise navigation as is the case with "hit-to-kill" vehicles and 2) it provides better penetration then blast fragmentation type warheads.

To date, however, kinetic energy rod warheads have not been widely accepted nor have they yet been deployed or fully designed. The primary components associated with a theoretical kinetic energy rod warhead is a hull, a projectile core or bay in the hull including a number of individual lengthy cylindrical projectiles, and an explosive charge in the hull about the projectile bay with sympthic explosive shields. When the explosive charge is detonated, the projectiles are deployed.

The cylindrical shaped projectiles, however, may tend to break and/or tumble in their deployment. Still other projectiles may approach the target at such a high oblique angle that they do not effectively penetrate the target. See "Aligned Rod Lethality Enhanced Concept for Kill Vehicles," R. Lloyd "Aligned Rod Lethality Enhancement Concept For Kill Vehicles" 10$^{th}$ AIAA/BMDD TECHNOLOGY CONF., Jul. 23–26, Williamsburg, Va., 2001 incorporated herein by this reference.

SUMMARY OF THE INVENTION

It is therefore an object of this invention to provide an improved kinetic energy rod warhead.

It is a further object of this invention to provide a higher lethality kinetic energy rod warhead.

It is a further object of this invention to provide a kinetic energy rod warhead with structure therein which aligns the projectiles when they are deployed.

It is a further object of this invention to provide such a kinetic energy rod warhead which is capable of selectively directing the projectiles at a target.

It is a further object of this invention to provide such a kinetic energy rod warhead which prevents the projectiles from breaking when they are deployed.

It is a further object of this invention to provide such a kinetic energy rod warhead which prevents the projectiles from tumbling when they are deployed.

It is a further object of this invention to provide such a kinetic energy rod warhead which insures the projectiles approach the target at a better penetration angle.

It is a further object of this invention to provide such a kinetic energy rod warhead which can be deployed as part of a missile or as part of a "hit-to-kill" vehicle.

It is a further object of this invention to provide such a kinetic energy rod warhead with projectile shapes which have a better chance of penetrating a target.

It is a further object of this invention to provide such a kinetic energy rod warhead with projectile shapes which can be packed more densely.

It is a further object of this invention to provide such a kinetic energy rod warhead which has a better chance of destroying all of the bomblets and chemical submunition payloads of a target to thereby better prevent casualties.

The invention results from the realization that a higher lethality kinetic energy rod warhead can be effected by the inclusion of means for reducing the angle of deployment of the individual projectiles when they are deployed.

This invention features a kinetic energy rod warhead comprising a projectile core including a plurality of individual projectiles, an explosive charge about the core, at least one detonator for the explosive charge, and means for reducing the deployment angles of the projectiles when the detonator detonates the explosive charge.

In one embodiment, the structure for reducing the deployment angles includes a buffer between the explosive charge and the core. In one example, the buffer is a poly foam material and the buffer extends beyond the core. The means for reducing may also be or include multiple spaced detonators for the explosive charge to generate a flatter shock front. The detonators, in one embodiment, are located proximate the buffer.

Typically, an end plate is located on each side of the projectile core. Each end plate maybe made of steel or aluminum. The means for reducing may include an absorbing layer between each end plate and the core. In one example, the absorbing layer is made of aluminum. Another structure for reducing the deployment angles includes a buffer between the absorbing layer and the core. In one example, the buffer is a layer of poly foam. Still another structure for reducing the deployment angles includes a momentum trap on each end plate. In one example, the momentum trap is a thin layer of glass applied to the end plates.

Typically, the core includes a plurality of bays of projectiles. In this embodiment, the means for reducing may include a buffer disk between each bay. In one example, there are three bays of projectiles. Additional means for reducing includes selected projectiles which extend continuously through all the bays. In one example, selected projectiles extend continuously through each bay with frangible portions located at the intersections between two adjacent bays.

Typically, the core includes a binding wrap around a projectiles. And, in one example, the projectile core includes an encapsulant sealing the projectiles together. In one example, the encapsulant includes grease on each projectile and glass in the spaces between projectiles.

Typically, the explosive charge is divided into sections and there are shields between each explosive charge section. In one example, the shields are made of composite material such as steel sandwiched between Lexan layers. In the preferred embodiment, each explosive charge section is wedged-shaped having a proximal surface abutting the projectile core and a distal surface. Typically, the distal surface is tapered to reduce weight.

In one example, the projectiles have a hexagon shape and are made of tungsten. In other embodiments, the projectiles have a cylindrical cross section, a non-cylindrical cross section, a star-shaped cross section, or a cruciform cross section. The projectiles may have flat ends, a non-flat nose, a pointed nose, or a wedge shaped nose.

Further included may be means for aligning the individual projectiles when the explosive charge deploys the projectiles. In one embodiment, the means for aligning includes a plurality of detonators space along the explosive charge configured to prevent sweeping shock waves at the interface of the projectile core and the explosive charge to prevent tumblings of the projectiles. In another embodiment, the means for aligning includes a body in the core with orifices therein, the projectiles disposed in the orifices of the body. In one example, the body is made of low density material. In another embodiment, the means for aligning includes a flux compression generator which generates a magnetic alignment field to align the projectiles. In one example, there are two flux compression generators, one on each end of the projectile core and each flux compression generator includes a magnetic core element, a number of coils about the magnetic core element, and an explosive for the imploding the magnetic core element.

This invention also features a kinetic energy rod warhead with lower deployment angles comprising a projectile core including a plurality of bays of individual projectiles, an explosive charge about the core divided into sections, shields between each explosive charge section, at least one detonator associated with selected explosive charge sections for aiming the projectiles in a predetermine primary firing direction, an end plate on each side of the projectile core, and a buffer between the explosive charge and a core to reduce the deployment angles of the projectiles when the detonators detonate the explosive charge.

A kinetic energy rod warhead in accordance with this invention may include a projectile core including a plurality of bays of individual projectiles, an explosive charge about the core divided into sections, shields between each explosive charge section, a plurality of spaced detonators associated with selected explosive charge sections, an end plate on each end of the projectile core, a buffer between the explosive charge and the core extending beyond the core, and a buffer between each projectile bay.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
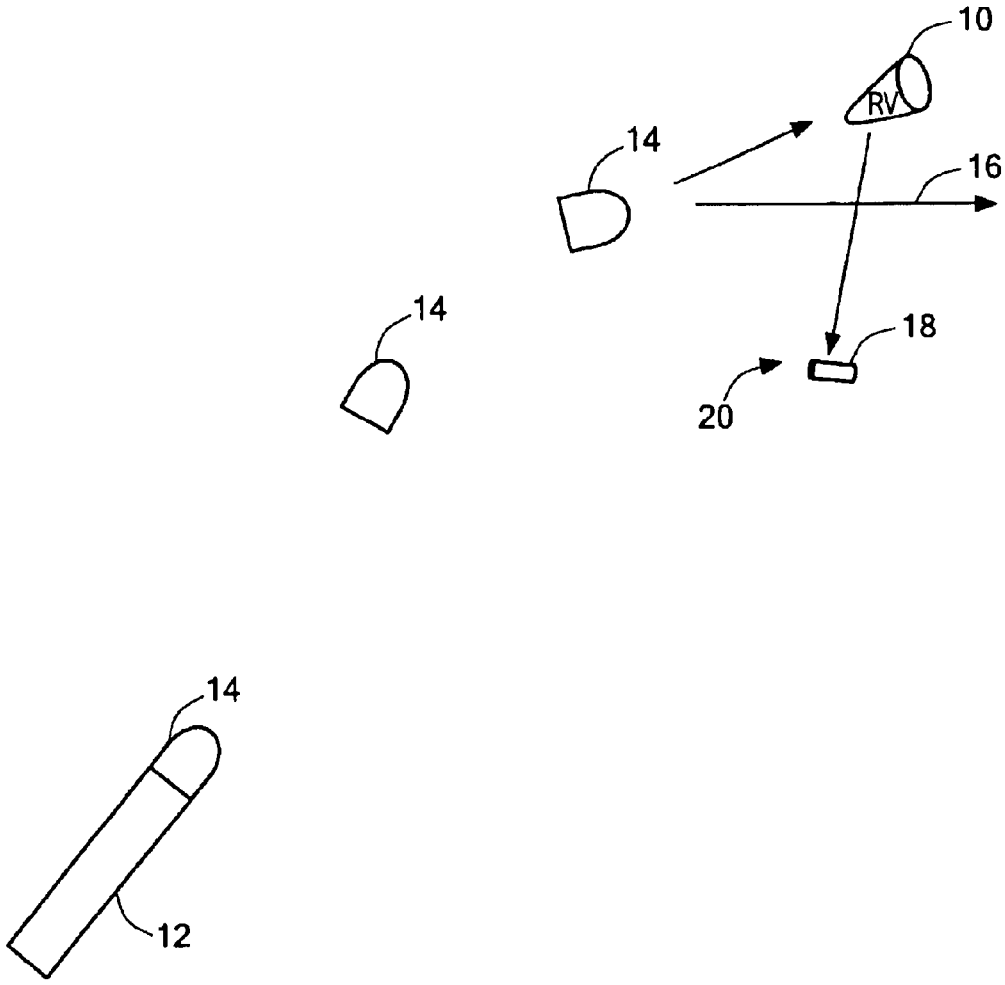
FIG. 1 PRIOR ART
FIG. 1 is schematic view showing the typical deployment of a "hit-to-kill" vehicle in accordance with the prior art.

As discussed in the Background section above, "hit-to-kill" vehicles are typically launched into a position proximate a re-entry vehicle 10, FIG. 1 or other target via a missile 12. "Hit-to-kill" vehicle 14 is navigable and designed to strike re-entry vehicle 10 to render it inoperable. Countermeasures, however, can be used to avoid the kill vehicle. Vector 16 shows kill vehicle 14 missing re-entry vehicle 10. Moreover, biological bomblets and chemical submunition payloads 18 are carried by some threats and one or more of these bomblets or chemical submunition payloads 18 can survive, as shown at 20, and cause heavy casualties even if kill vehicle 14 does accurately strike target 10.

Figure 2:
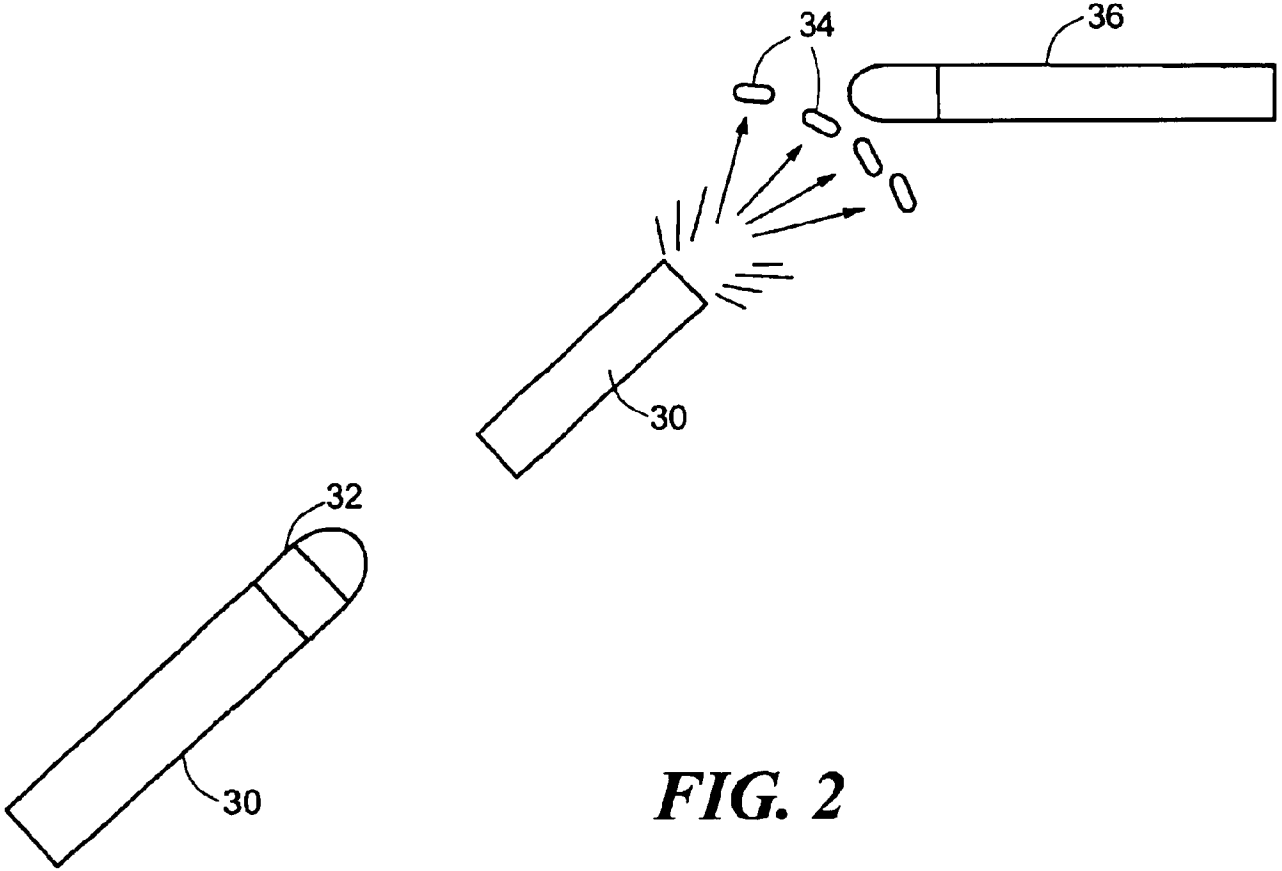
FIG. 2 PRIOR ART
FIG. 2 is schematic view showing the typical deployment of a prior art blast fragmentation type warhead.

Turning to FIG. 2, blast fragmentation type warhead 32 is designed to be carried by missile 30. When the missile reaches a position close to an enemy re-entry vehicle (RV), missile, or other target 36, a pre-made band of metal or fragments on the warhead is detonated and the pieces of metal 34 strike target 36. The fragments, however, are not always effective at destroying the submunition target and, again, biological bomblets and/or chemical submunition payloads can survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook, proposes a kinetic energy rod warhead.

Figure 3:
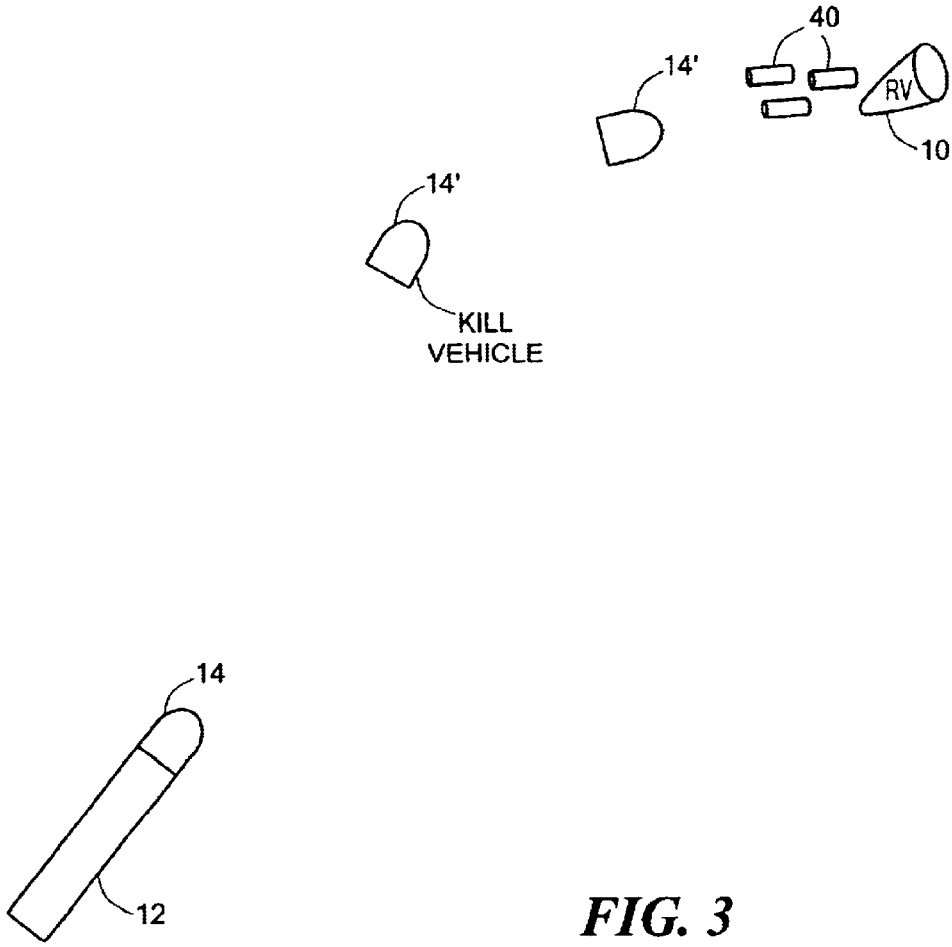
FIG. 3 is schematic view showing the deployment of a kinetic energy rod warhead system incorporated with a "hit-to-kill" vehicle in accordance with the subject invention.
Figure 4:
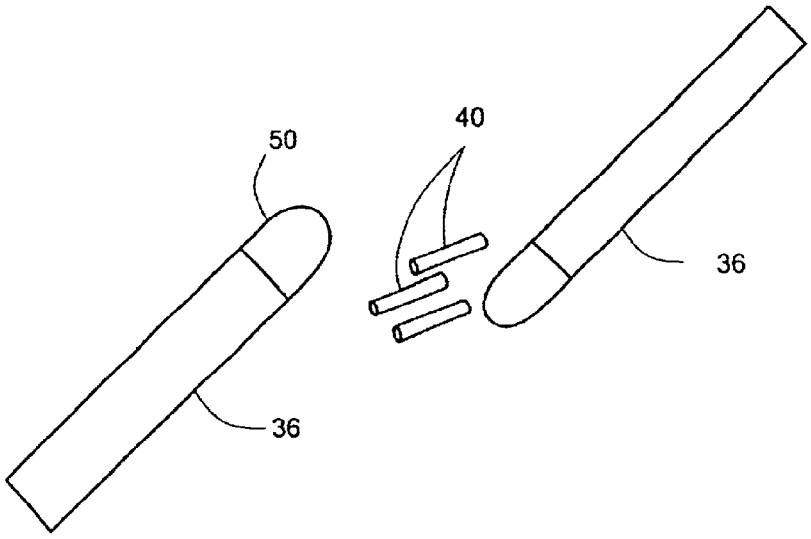
FIG. 4 is schematic view showing the deployment of a kinetic energy rod warhead as a replacement for a blast fragmentation type warhead in accordance with the subject invention.

In general, a kinetic energy rod warhead, in accordance with this invention, can be added to kill vehicle 14, FIG. 3 to deploy lengthy cylindrical projectiles 40 directed at re-entry vehicle 10 or another target. In addition, the prior art blast fragmentation type warhead shown in FIG. 2 can be replaced with or supplemented with a kinetic energy rod warhead 50, FIG. 4 to deploy projectiles 40 at target 36.

Two key advantages of kinetic energy rod warheads as theorized is that 1) they do not rely on precise navigation as is the case with "hit-to-kill" vehicles and 2) they provide better penetration then blast fragmentation type warheads.

Figure 5:
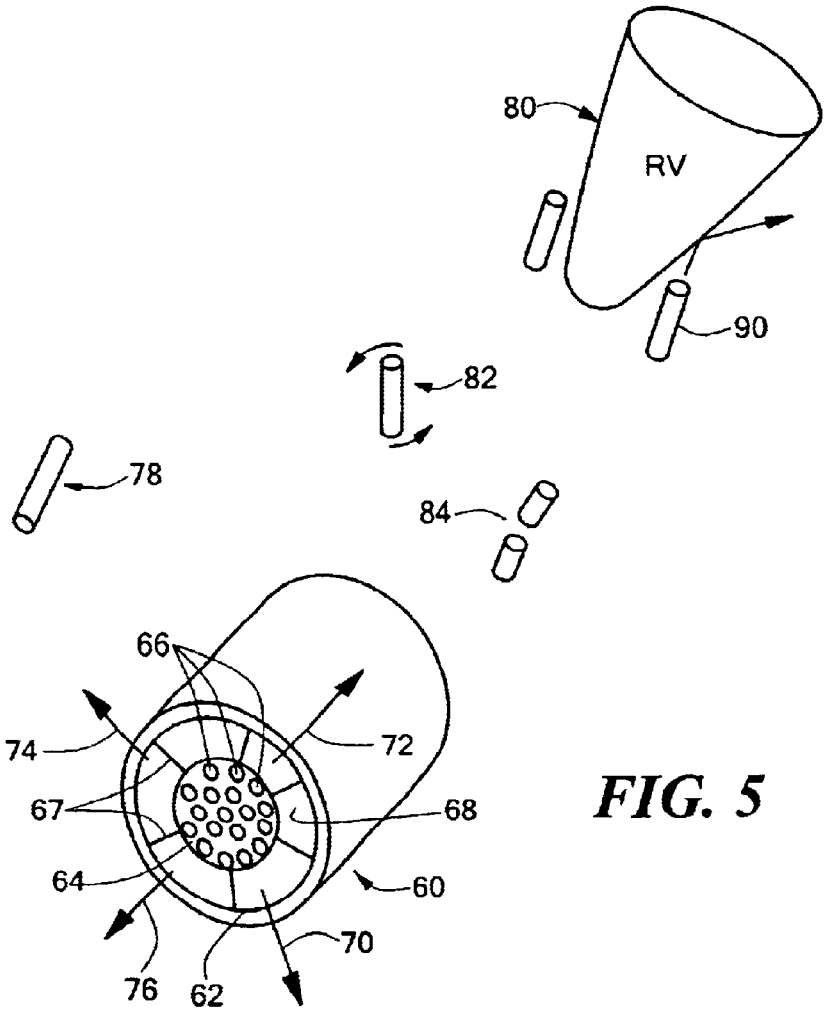
FIG. 5 is a more detailed view showing the deployment of the projectiles of a kinetic energy rod warhead at a target in accordance with the subject invention.

To date, however, kinetic energy rod warheads have not been widely accepted nor have they yet been deployed or fully designed. The primary components associated with a theoretical kinetic energy rod warhead 60, FIG. 5 is hull 62, projectile core or bay 64 in hull 62 including a number of individual lengthy cylindrical rod projectiles 66, sympethic shield 67, and explosive charge 68 in hull 62 about bay or core 64. When explosive charge 66 is detonated, projectiles 66 are deployed as shown by vectors 70, 72, 74, and 76.

Note, however, that in FIG. 5 the projectile shown at 78 is not specifically aimed or directed at re-entry vehicle 80. Note also that the cylindrical shaped projectiles may tend to break upon deployment as shown at 84. The projectiles may also tend to tumble in their deployment as shown at 82. Still other projectiles approach target 80 at such a high oblique angle that they do not penetrate target 80 effectively as shown at 90.

In this invention, the kinetic energy rod warhead includes, inter alia, means for aligning the individual projectiles when the explosive charge is detonated and deploys the projectiles to prevent them from tumbling and to insure the projectiles approach the target at a better penetration angle.

Figure 6:
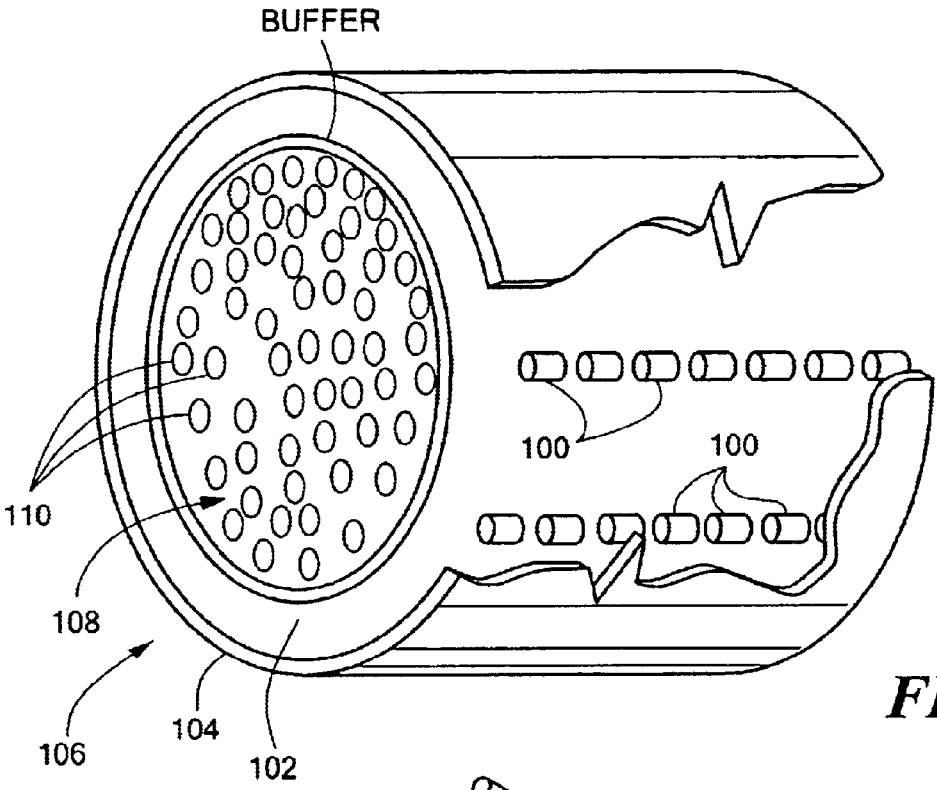
FIG. 6 is three-dimensional partial cut-away view of one embodiment of the kinetic energy rod warhead system of the subject invention.

In one example, the means for aligning the individual projectiles include a plurality of detonators 100, FIG. 6 (typically chip slapper type detonators) spaced along the length of explosive charge 102 in hull 104 of kinetic energy rod warhead 106. As shown in FIG. 6, projectile core 108 includes many individual lengthy cylindrical projectiles 110 and, in this example, explosive charge 102 surrounds projectile core 108. By including detonators 100 spaced along the length of explosive charge 102, sweeping shock waves are prevented at the interface between projectile core 108 and explosive charge 102 which would otherwise cause the individual projectiles 110 to tumble.

Figure 7:
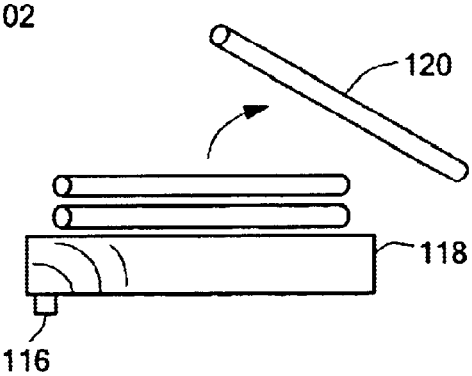
FIG. 7 is schematic cross-sectional view showing a tumbling projectile in accordance with prior kinetic energy rod warhead designs.

As shown in FIG. 7, if only one detonator 116 is used to detonate explosive 118, a sweeping shockwave is created which causes projectile 120 to tumble. When this happens, projectile 120 can fracture, break or fail to penetrate a target which lowers the lethality of the kinetic energy rod warhead.

By using a plurality of detonators 100 spaced along the length of explosive charge 108, a sweeping shock wave is prevented and the individual projectiles 100 do not tumble as shown at 122.

Figure 9:
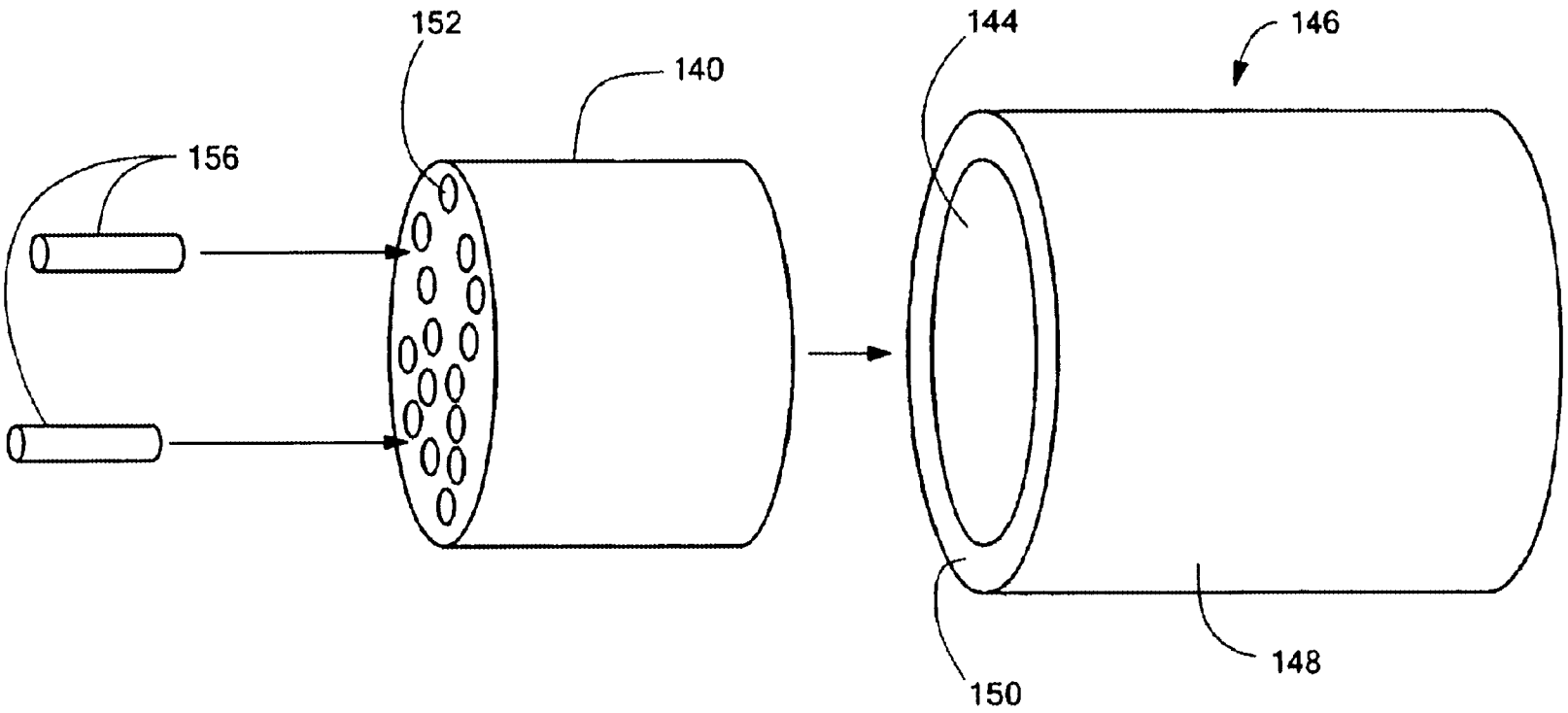
FIG. 9 is an exploded schematic three-dimensional view showing the use of a kinetic energy rod warhead core body used to align the projectiles in accordance with the subject invention.

In another example, the means for aligning the individual projectiles includes low density material (e.g., foam) body 140, FIG. 9 disposed in core 144 of kinetic energy rod warhead 146 which, again, includes hull 148 and explosive charge 150. Body 140 includes orifices 152 therein which receive projectiles 156 as shown. The foam matrix acts as a rigid support to hold all the rods together after initial deployment. The explosive accelerates the foam and rods toward the RV or other target. The foam body holds the rods stable for a short period of time keeping the rods aligned. The rods stay aligned because the foam reduces the explosive gases venting through the packaged rods.

Figure 8:
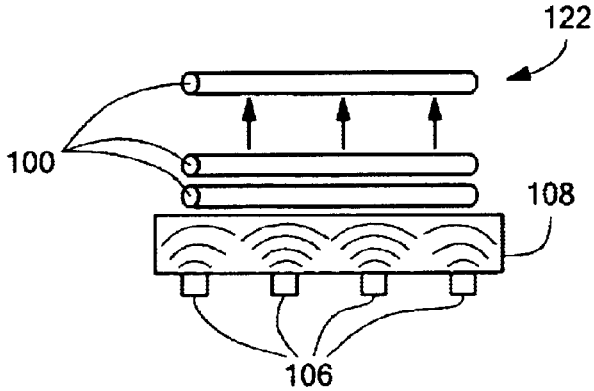
FIG. 8 is another schematic cross-sectional view showing how the use of multiple detonators aligns the projectiles to prevent tumbling thereof in accordance with the subject invention.

In one embodiment, foam body 140, FIG. 9 maybe combined with the multiple detonator design of FIGS. 6 and 8 for improved projectile alignment.

Figure 10:
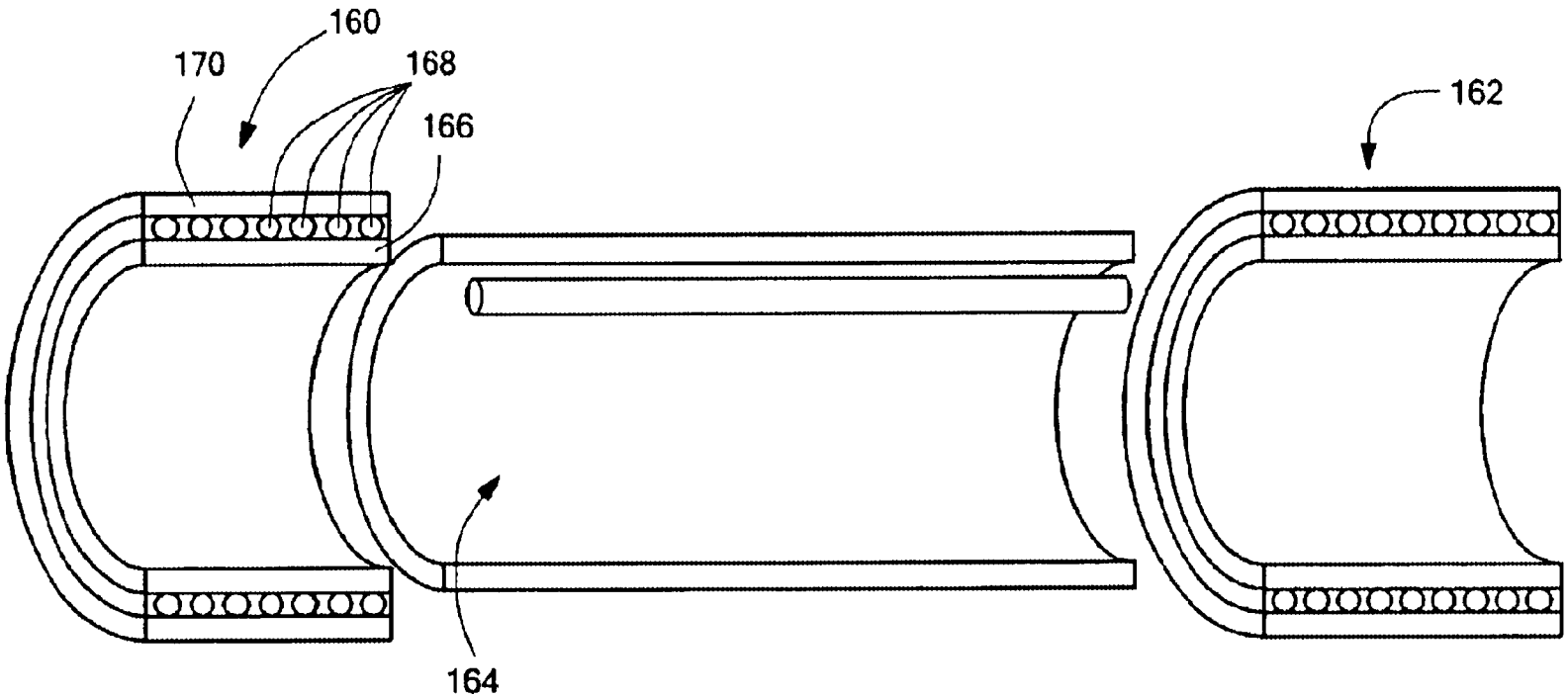
FIGS. 10 and 11 are schematic cut-away views showing the use of flux compression generators used to align the projectiles of the kinetic energy rod warhead in accordance with the subject invention.

In still another example, the means for aligning the individual projectiles to prevent tumbling thereof includes flux compression generators 160 and 162, FIG. 10, one on each end of projectile core 164 each of which generate a magnetic alignment field to align the projectiles. Each flux compression generator includes magnetic core element 166 as shown for flux compression generator 160, a number of coils 168 about core element 166, and explosive charge 170 which implodes magnetic core element when explosive charge 170 is detonated. The specific design of flux compression generators is known to those skilled in the art and therefore no further details need be provided here.

Figure 11:
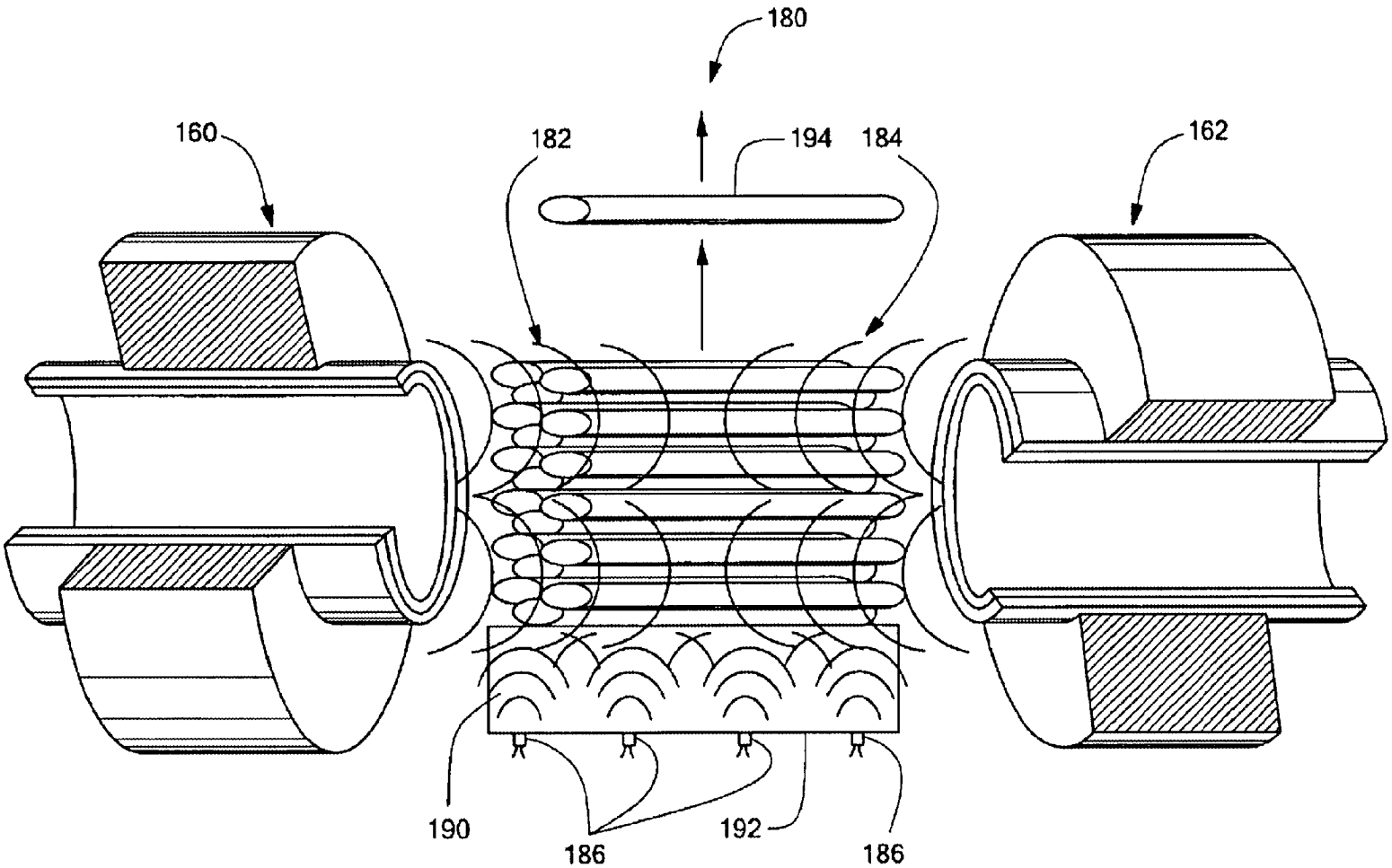

As shown in FIG. 11, kinetic energy rod warhead 180 includes flux compression generators 160 and 162 which generate the alignment fields shown at 182 and 184 and also multiple detonators 186 along the length of explosive charge 190 which generate a flat shock wave front as shown at 192 to align the projectiles at 194. As stated above, foam body 140 may also be included in this embodiment to assist with projectile alignment.

Figure 12:
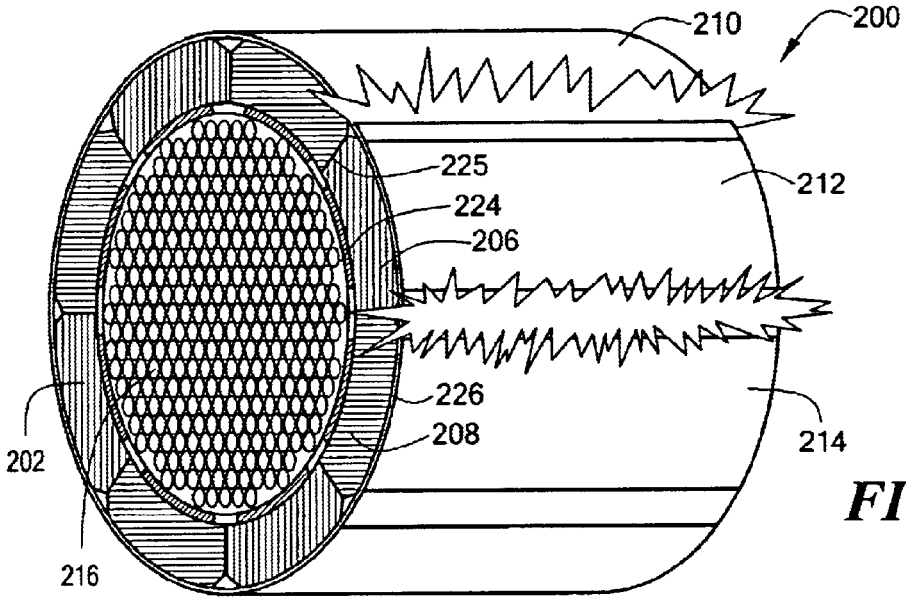
FIGS. 12–15 are schematic three-dimensional views showing how the projectiles of the kinetic energy rod warhead of the subject invention are aimed in a particular direction in accordance with the subject invention.
Figure 13:
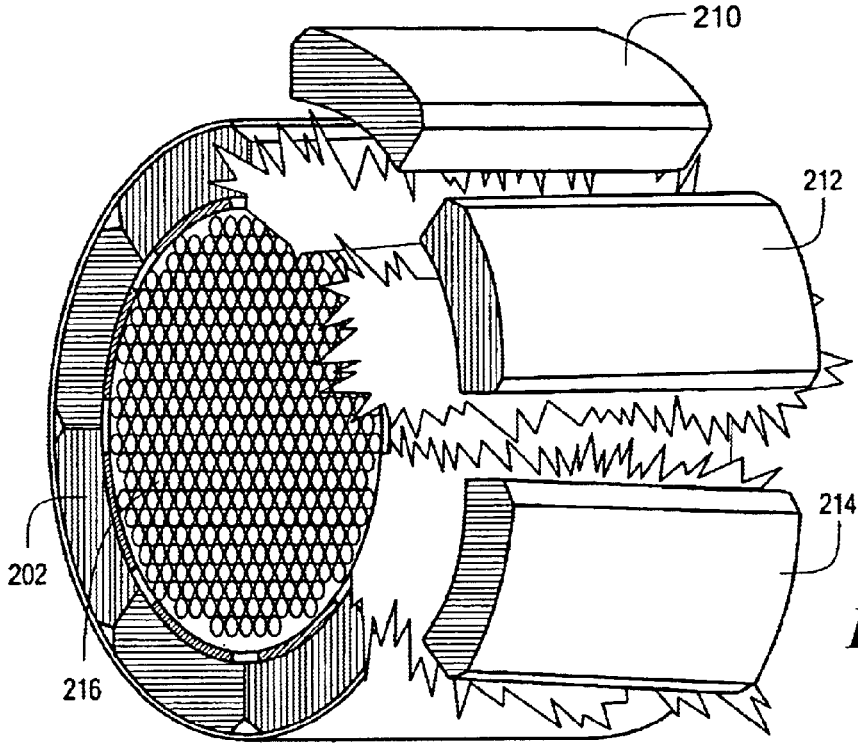
Figure 14:
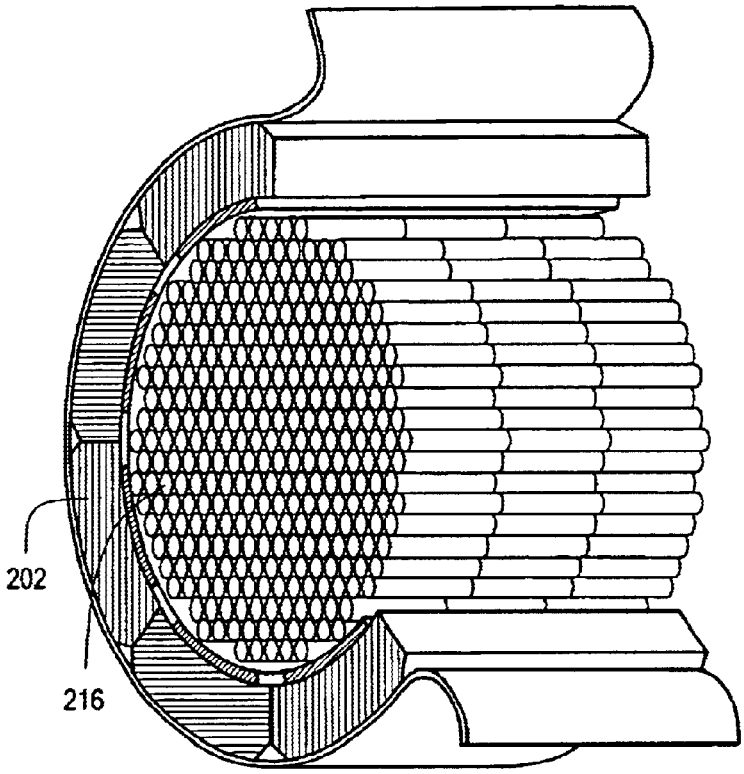
Figure 15:
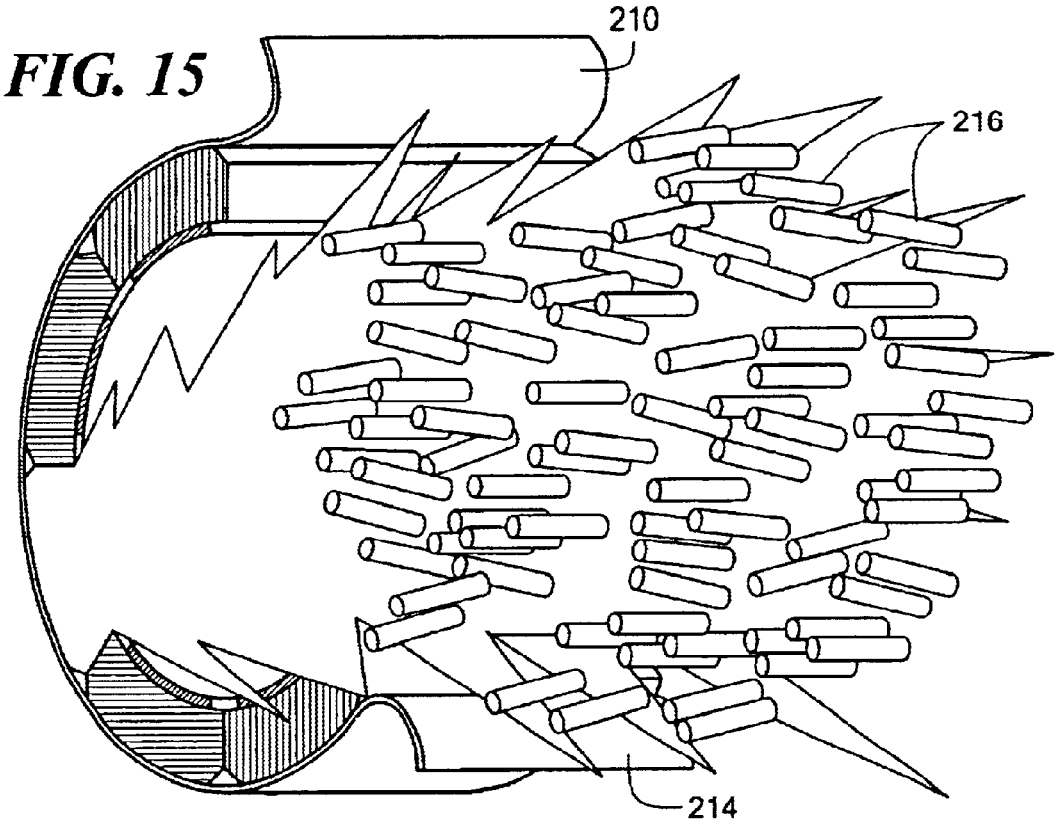

In FIG. 12, kinetic energy rod warhead 200 includes an explosive charge divided into a number of sections 202, 204, 206, and 208. Shields such as shield 225 separates explosive charge sections 204 and 206. Shield 225 maybe made of a composite material such as a steel core sandwiched between inner and outer lexan layers to prevent the detonation of one explosive charge section from detonating the other explosive charge sections. Detonation cord resides between hull sections 210, 212, and 214 each having a jettison explosive pack 220, 224, and 226. High density tungsten rods 216 reside in the core or bay of warhead 200 as shown. To aim all of the rods 216 in a specific direction and therefore avoid the situation shown at 78 in FIG. 5, the detonation cord on each side of hull sections 210, 212, and 214 is initiated as are jettison explosive packs 220, 222, and 224 as shown in FIGS. 13–14 to eject hull sections 210, 212, and 214 away from the intended travel direction of projectiles 216. Explosive charge section 202, FIG. 14 is then detonated as shown in FIG. 15 using a number of detonators as discussed with reference to FIGS. 6 and 8 to deploy projectiles 216 in the direction of the target as shown in FIG. 15. Thus, by selectively detonating one or more explosive charge sections, the projectiles are specifically aimed at the target in addition to being aligned using the aligning structures shown and discussed with reference to FIGS. 6 and 8 and/or FIG. 9 and/or FIG. 10.

In addition, the structure shown in FIGS. 12–15 assists in controlling the spread pattern of the projectiles. In one example, the kinetic energy rod warhead of this invention employs all of the alignment techniques shown in FIGS. 6 and 8–10 in addition to the aiming techniques shown in FIGS. 12–15.

Typically, the hull portion referred to in FIGS. 6–9 and 12–15 is either the skin of a missile (see FIG. 4) or a portion added to a "hit-to-kill" vehicle (see FIG. 3).

Figure 16:
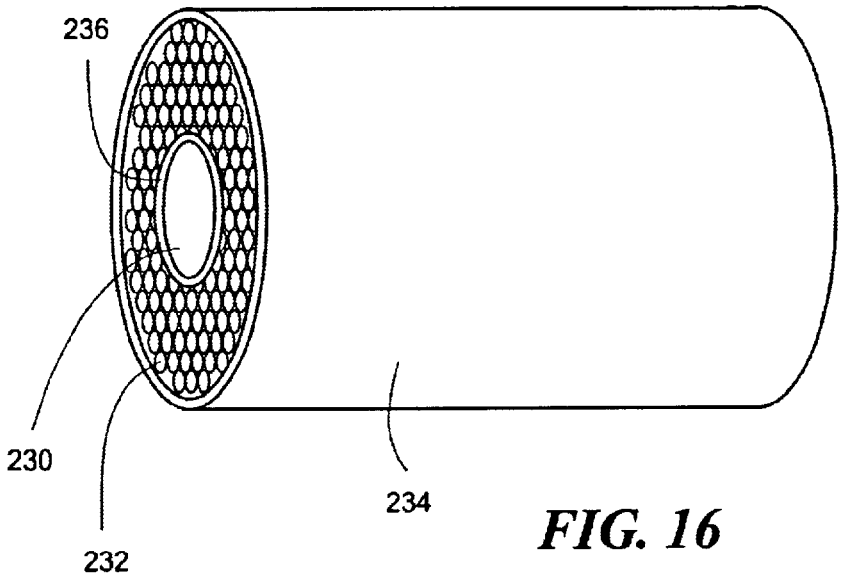
FIG. 16 is a three dimensional schematic view showing another embodiment of the kinetic energy rod warhead of the subject invention.
Figure 22:
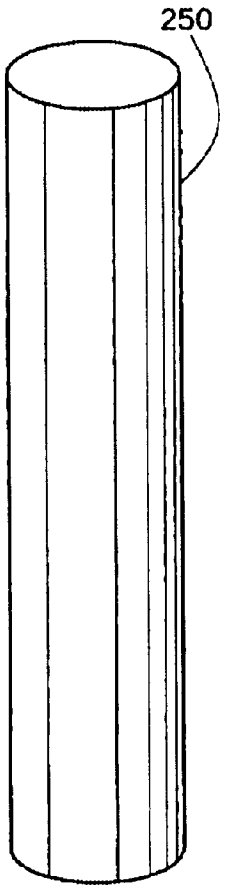
FIGS. 17–23 are three-dimensional views showing different projectile shapes useful in the kinetic energy rod warhead of the subject invention.
Figure 21:
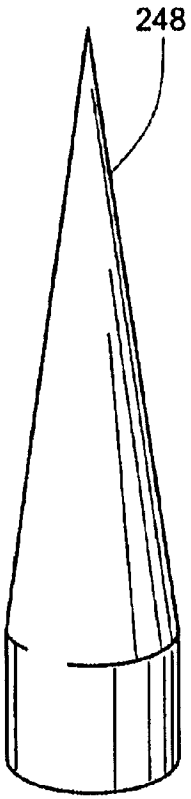
Figure 20:
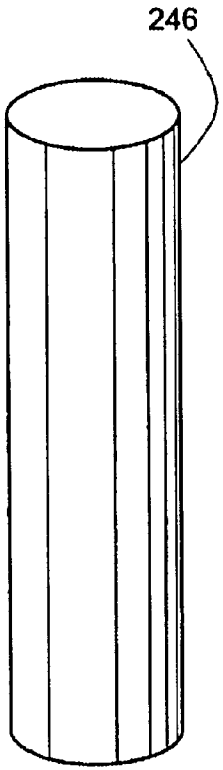
Figure 19:
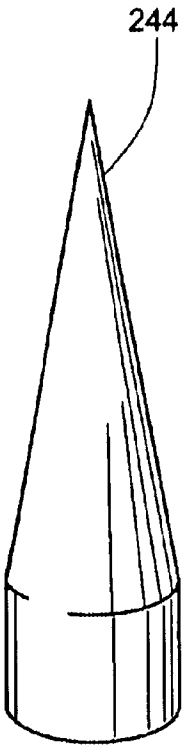
Figure 18:
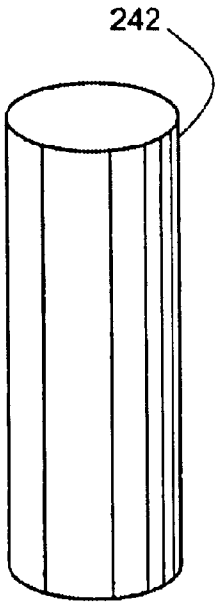
Figure 17:
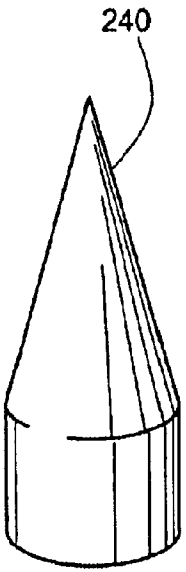
Figure 23:
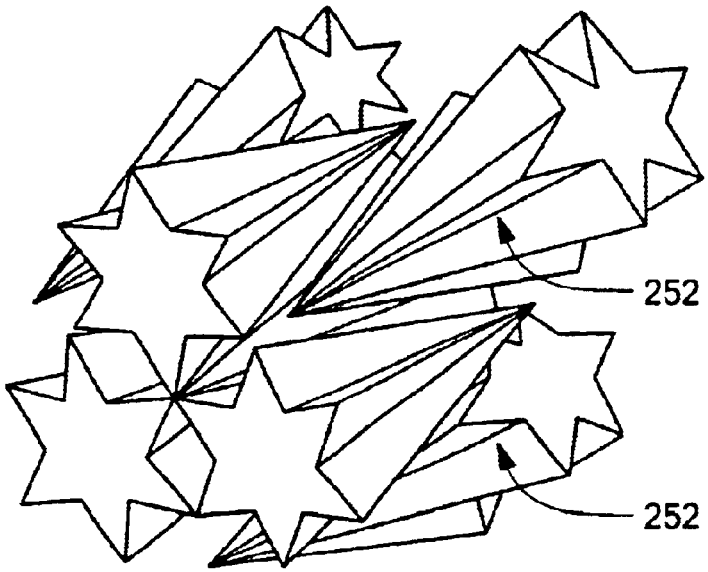

Thus far, the explosive charge is shown disposed about the outside of the projectile or rod core. In another example, however, explosive charge 230, FIG. 16 is disposed inside rod core 232 within hull 234. Further included may be low density material (e.g., foam) buffer material 236 between core 232 and explosive charge 230 to prevent breakage of the projectile rods when explosive charge 230 is detonated.

Thus far, the rods and projectiles disclosed herein have been shown as lengthy cylindrical members made of tungsten, for example, and having opposing flat ends. In another example, however, the rods have a non-cylindrical cross section and non-flat noses. As shown in FIGS. 17–24, these different rod shapes provide higher strength, less weight, and increased packaging efficiency. They also decrease the chance of a ricochet off a target to increase target penetration especially when used in conjunction with the alignment and aiming methods discussed above.

Figure 24:
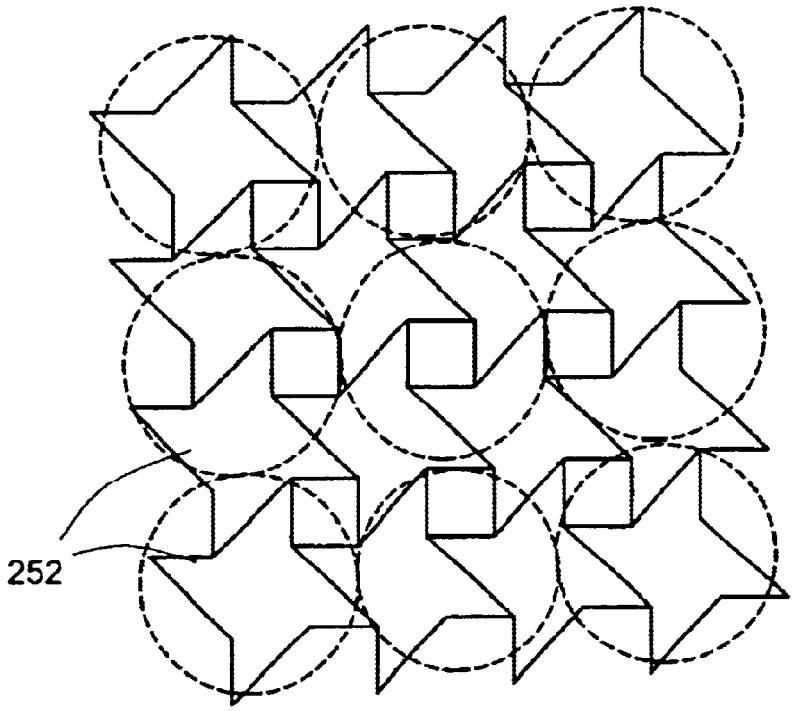
FIG. 24 is a end view showing a number of star-shaped projectiles in accordance with the subject invention and the higher packing density achieved by the use thereof.

Typically, the preferred projectiles do not have a cylindrical cross section and instead may have a star-shaped cross section, a cruciform cross section, or the like. Also, the projectiles may have a pointed nose or at least a non-flat nose such as a wedge-shaped nose. Projectile 240, FIG. 17 has a pointed nose while projectile 242, FIG. 18 has a star-shaped nose. Other projectile shapes are shown at 244, FIG. 19 (a star-shaped pointed nose); projectile 246, FIG. 20; projectile 248, FIG. 21; and projectile 250, FIG. 22. Projectiles 252, FIG. 23 have a star-shaped cross section, pointed noses, and flat distal ends. The increased packaging efficiency of these specially shaped projectiles is shown in FIG. 24 where sixteen star-shaped projectiles can be packaged in the same space previously occupied by nine penetrators or projectiles with a cylindrical shape.

Figure 25:
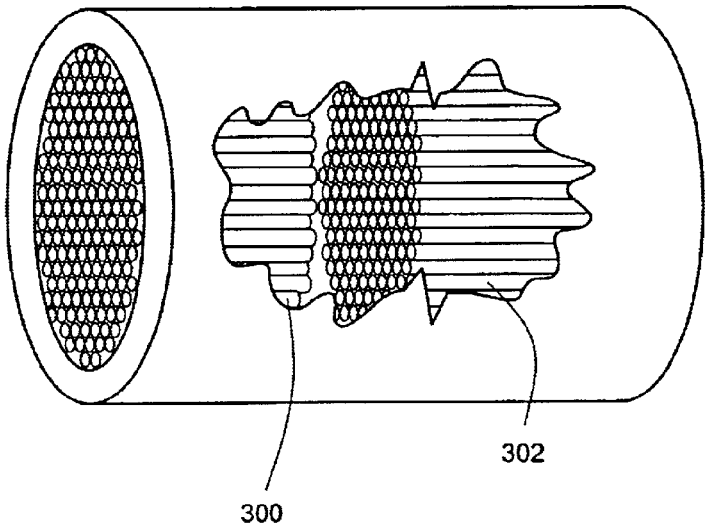
FIG. 25 is another schematic three-dimensional partially cut-away view of another embodiment of the kinetic energy rod warhead system of the subject invention wherein there are a number of projectile bays.

Thus far, it is assumed there is only one set of projectiles. In another example, however, the projectile core is divided into a plurality of bays 300 and 302, FIG. 25.

Figure 26:
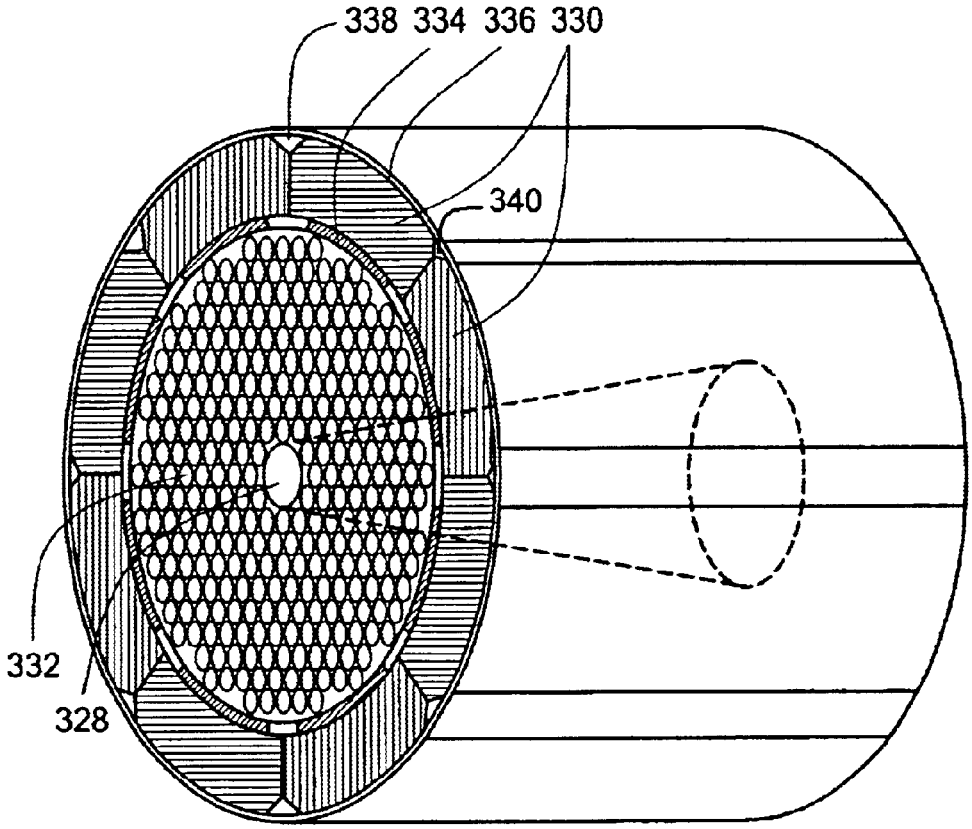
FIG. 26 is another three-dimensional schematic view showing an embodiment of the kinetic energy rod warhead system of this invention wherein the explosive core is wedge shaped to provide a uniform projectile spray pattern in accordance with the subject invention.
Figure 27:
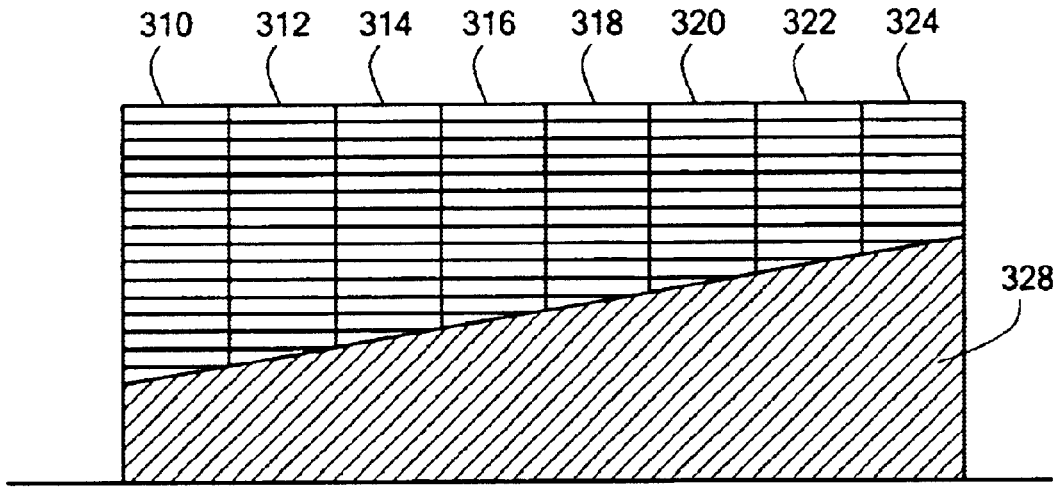
FIG. 27 is a cross sectional view showing a wedge shaped explosive core and bays of projectiles adjacent it for the kinetic energy rod warhead system shown in FIG. 26.

Again, this embodiment may be combined with the embodiments shown in FIGS. 6 and 8–24. In FIGS. 26 and 27, there are eight projectile bays 310–324 and cone shaped explosive core 328 which deploys the rods of all the bays at different velocities to provide a uniform spray pattern. Also shown in FIG. 26 is wedged shaped explosive charge sections 330 with narrower proximal surface 334 abutting projectile core 332 and broader distal surface 336 abutting the hull of the kinetic energy rod warhead. Distal surface 336 is tapered as shown at 338 and 340 to reduce the weight of the kinetic energy rod warhead.

Figure 28:
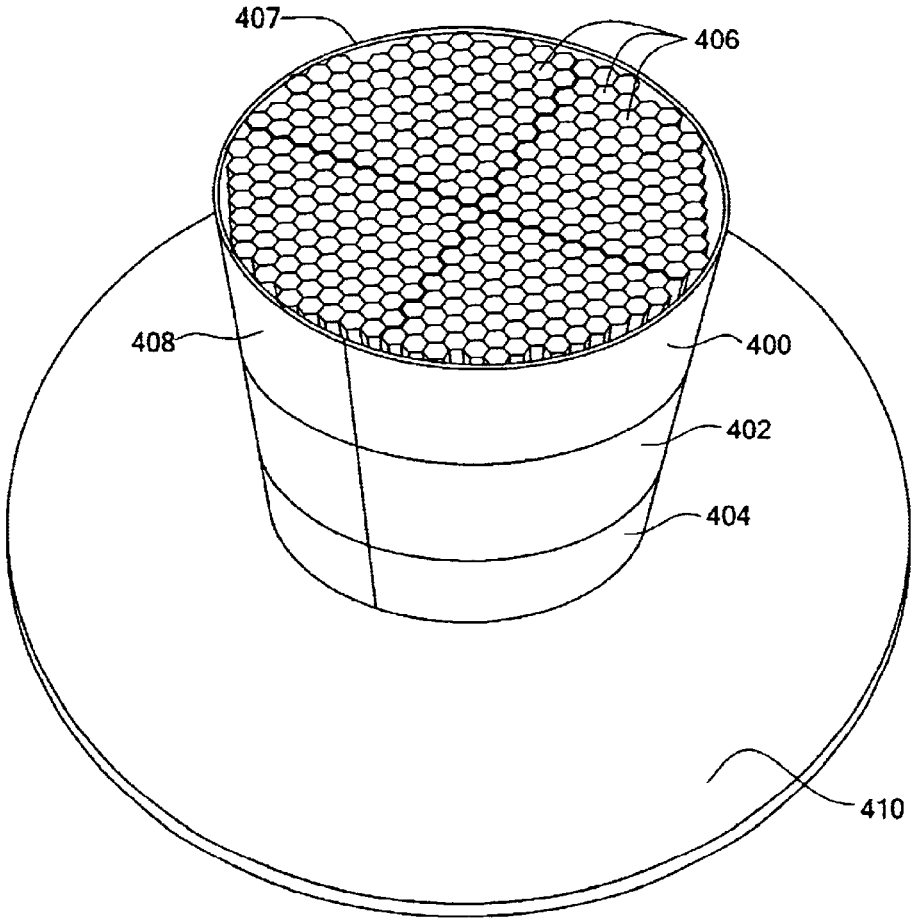
FIG. 28 is a schematic depiction of a test version of a kinetic energy rod warhead in accordance with the subject invention with three separate rod bays.

In one test example, the projectile core included three bays 400, 402 and 404, FIG. 28 of hexagon shaped tungsten projectiles 406. The other projectile shapes shown in FIGS. 17–24 may also be used. Each bay was held together by fiber glass wrap 408 as shown for bay 400. The bays 400, 402 and 404 rest on steel end plate 410. Buffer 407 is inserted around the rod core. This buffer reduces the explosive edge effects acting against the outer rods. By mitigating the energy acting on the edge rods it will reduce the spray angle from the explosive shock waves.

Figure 29:
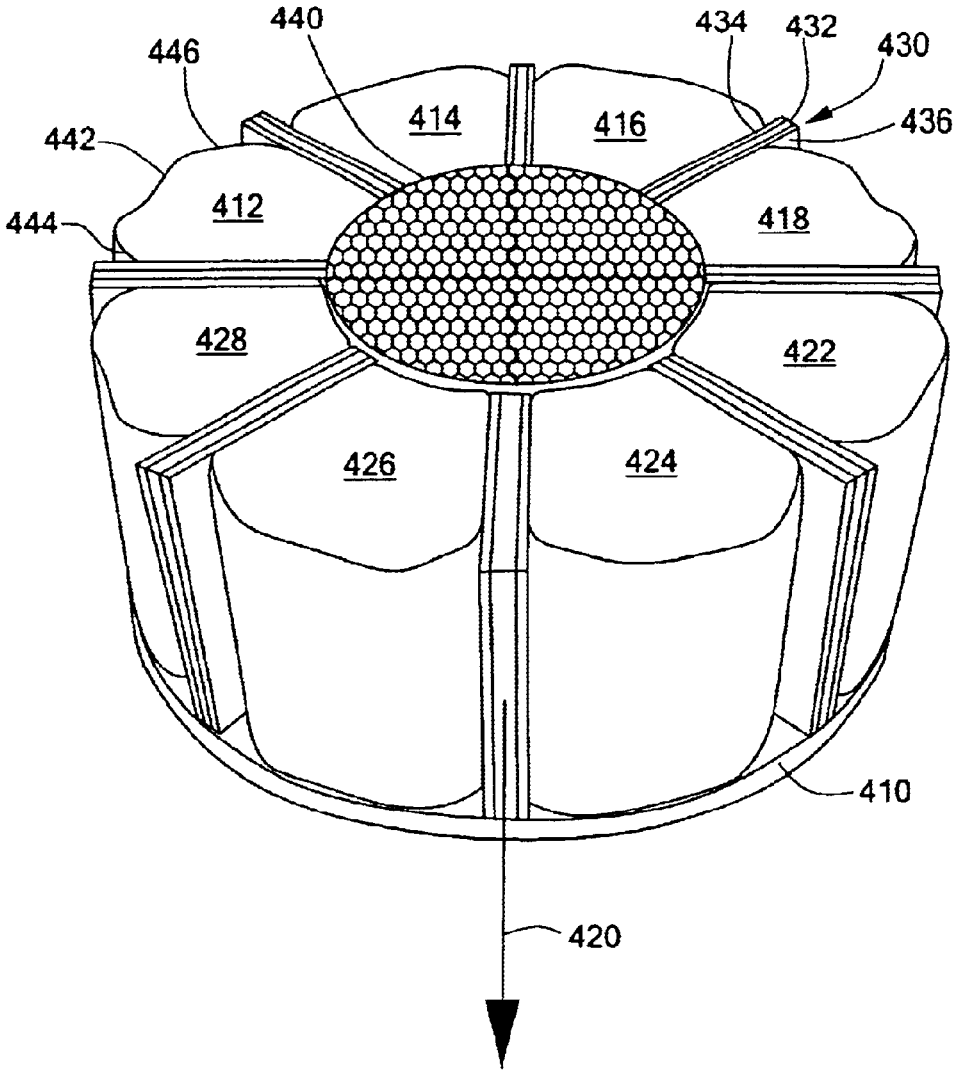
FIG. 29 is a schematic depiction of the warhead of FIG. 28 after the explosive charge sections are added.

Next, explosive charge sections 412, 414, 416 and 418, FIG. 29 were disposed on end plate 410 about the projectile core. Thus, the primary firing direction of the projectiles in this test example was along vector 420. Clay sections 422, 424, 426 and 428 simulated the additional explosive sections that would be used in a deployed warhead. Between each explosive charge section is sympathetic shield 430 typically comprising steel layer 432 sandwiched between layers of Lexan 434 and 436. Each explosive charge section is wedge shaped as shown with proximal surface 440 of explosive charge section 412 abutting the projectile core and distal surface 442 which is tapered as shown at 444 and 446 to reduce weight.

Figure 30:
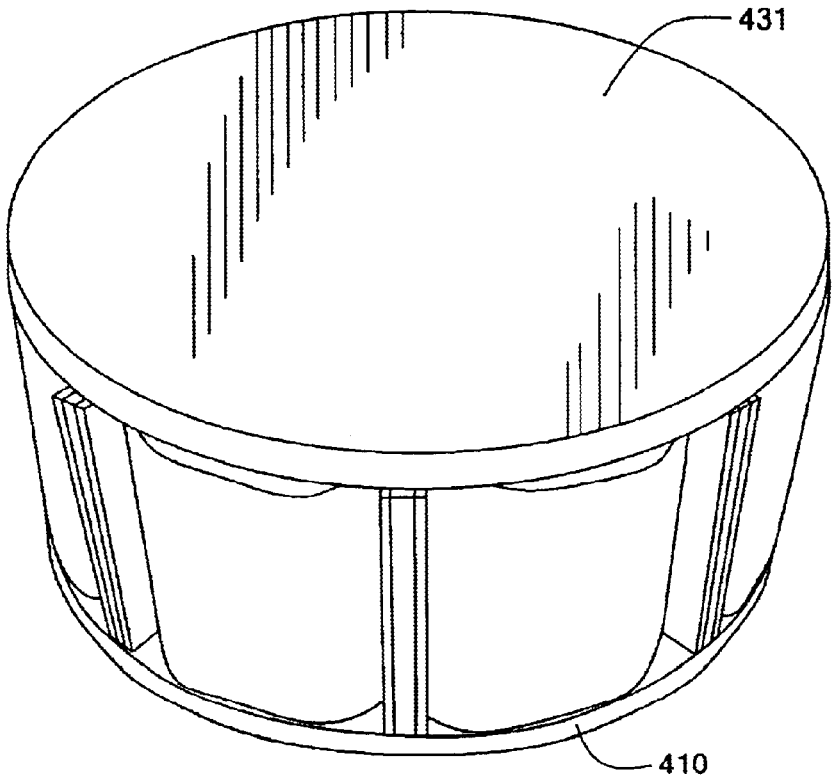
FIG. 30 is a schematic depiction of the rod warhead shown in FIGS. 28 and 29 after the addition of the top end plate.

65 Top end plate 431, FIG. 30 completes the assembly. End plates 410 and 431 could also be made of aluminum. The total weight of the projectile rods 406 was 65 lbs, the weight of the C4 explosive charge sections 412, 414, 416, and 418 was 10 lbs. Each rod weighed 35 grams and had a length to diameter ratio of 4. 271 rods were packaged in each bay with 823 rods total. The total weight of the assembly was 30.118 lbs.

Figure 31:
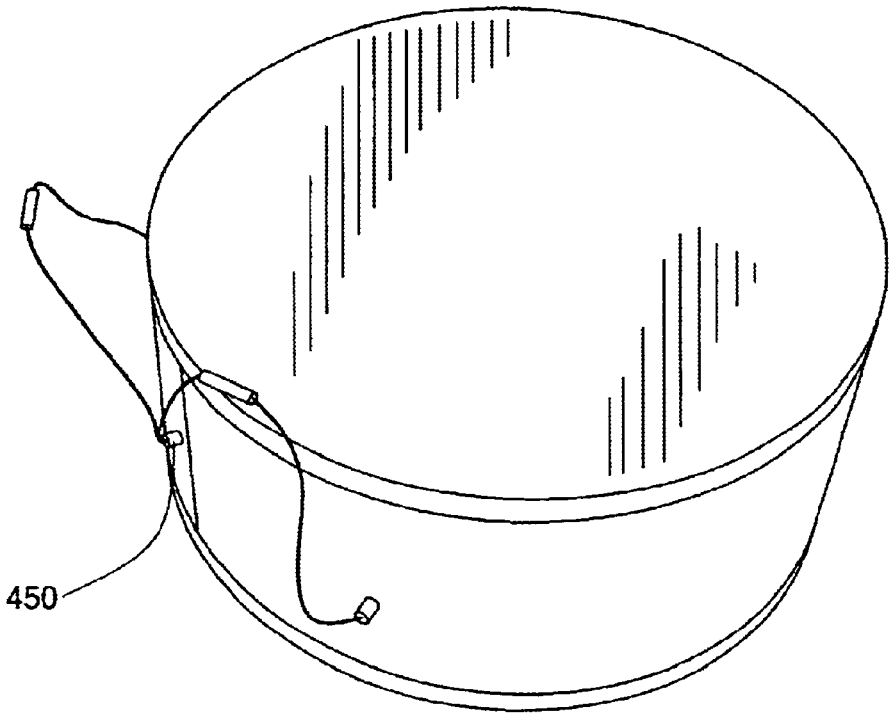
FIG. 31 is a schematic view of the kinetic energy rod warhead of FIG. 30 just before a test firing.
Figure 32:
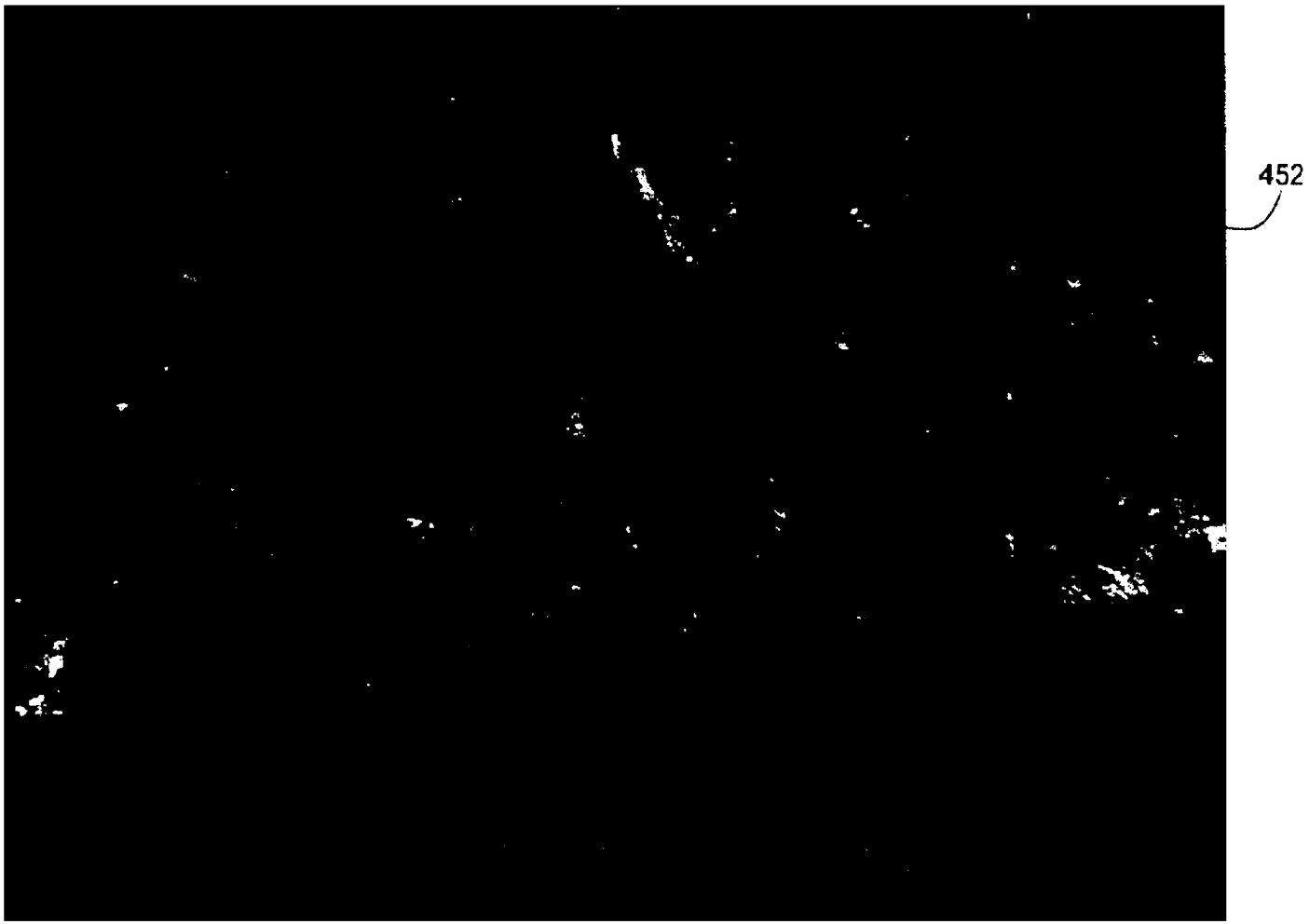
FIG. 32 is a schematic view showing the results of the impact of the individual rods after the test firing of the warhead showing in FIG. 31.
Figure 33:
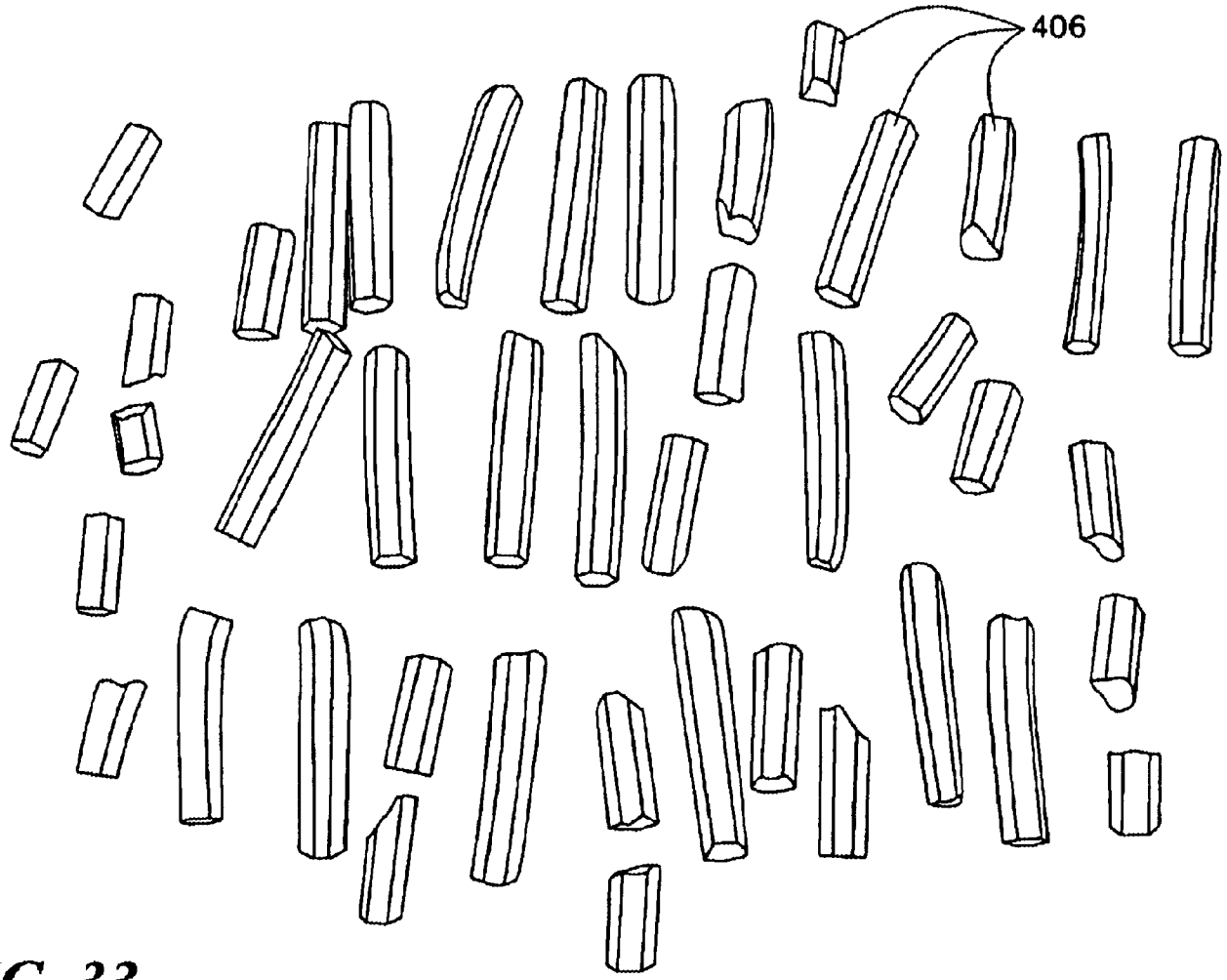
FIG. 33 is a schematic view showing a variety of individual penetrator rods after the test firing.

FIG. 31 shows the addition of detonators as shown at 450 just before test firing. There was one detonator per explosive charge section and all the detonators were fired simultaneously. FIGS. 32–33 shows the results after test firing. The individual projectiles struck test surface 452 as shown in FIG. 32 and the condition of certain recovered projectiles is shown in FIG. 33.

Figure 34:
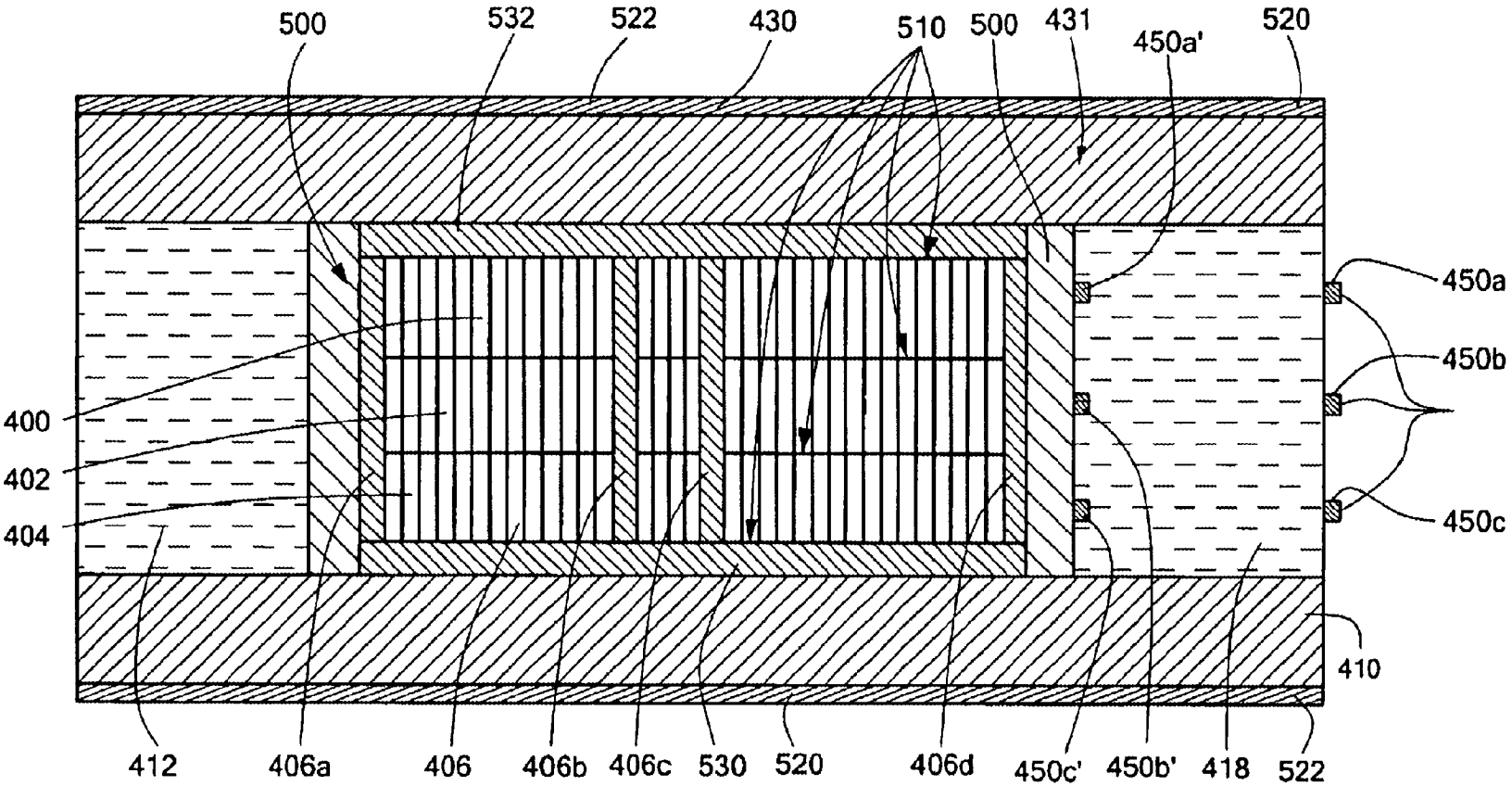
FIG. 34 is a schematic cross sectional view of a kinetic energy warhead with lower deployment angles in accordance with the subject invention.

To reduce the deployment angles of the projectiles when the detonators detonate the explosive charge sections thereby providing a tighter spray pattern useful for higher lethality in certain cases, several additional structures were added in the modified warhead of FIG. 34.

One means for reducing the deployment angles of projectiles 406 is the addition of buffer 500 between the explosive charge sections and the core. Buffer 500 is preferably a thin layer of poly foam ½ inch thick which also preferably extends beyond the core to plates 431 and 410. Buffer 500 reduces the edge effects of the explosive shock waves during deployment so that no individual rod experiences any edge effects.

Figure 35:
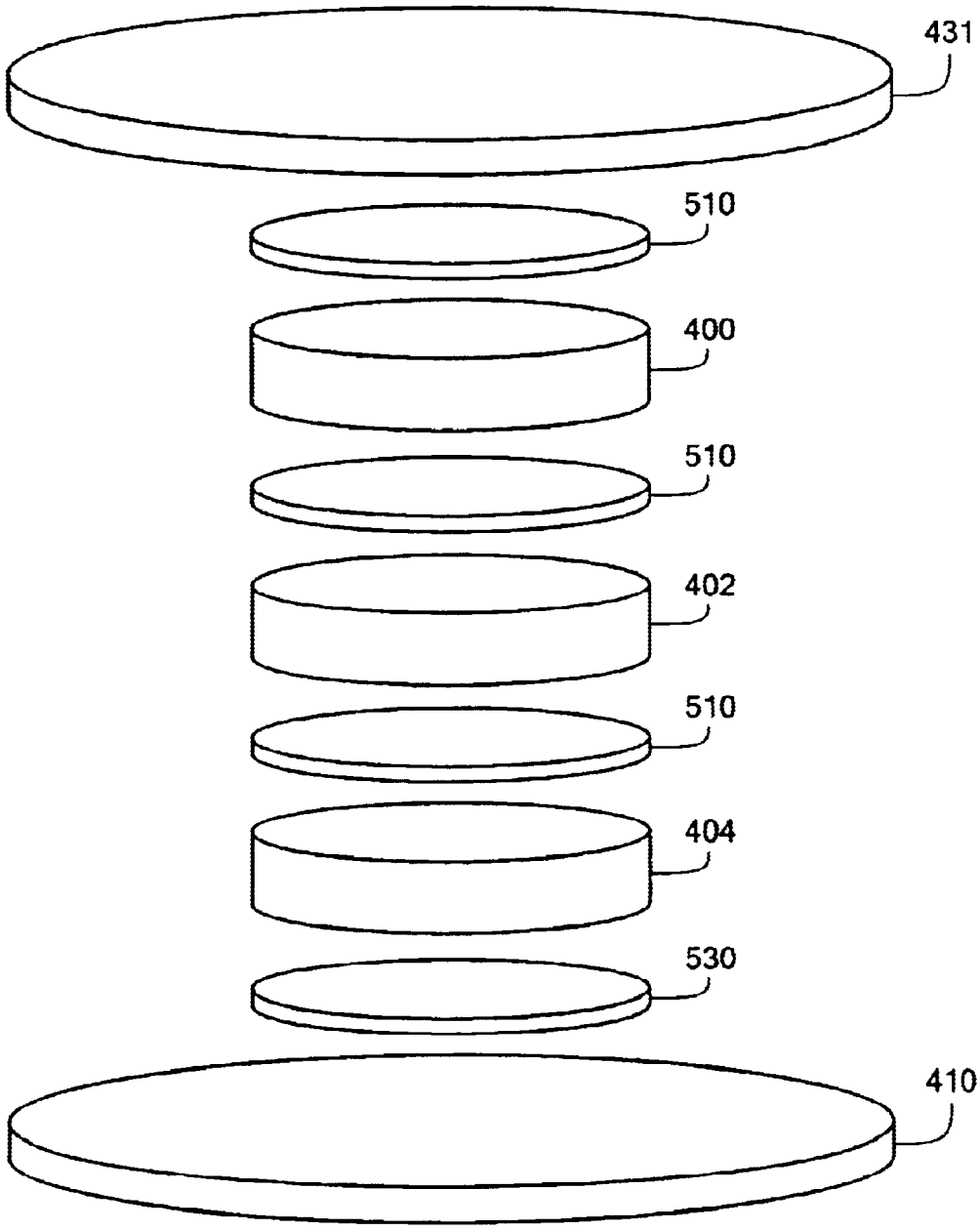
FIG. 35 is an exploded view showing the use of buffer disks between the individual bays of projectiles in order to lower the deployment angles of the rods in accordance with the subject invention.

Another means for reducing the deployment angles of the rods is the addition of poly foam buffer disks 510 also shown in FIG. 35. The disks are typically ⅛ inch thick and are placed between each end plate and the core and between each core bay as shown to reduce slap or shock interactions in the rod core.

Momentum traps 520 and 522 are preferably a thin layer of glass applied to the outer surface of each end plate 410 and 431. Also, thin aluminum absorbing layers 530 and 532 between each end plate and the core help to absorb edge effects and thus constitute a further means for tightening the spray pattern of the rods.

Figure 36:
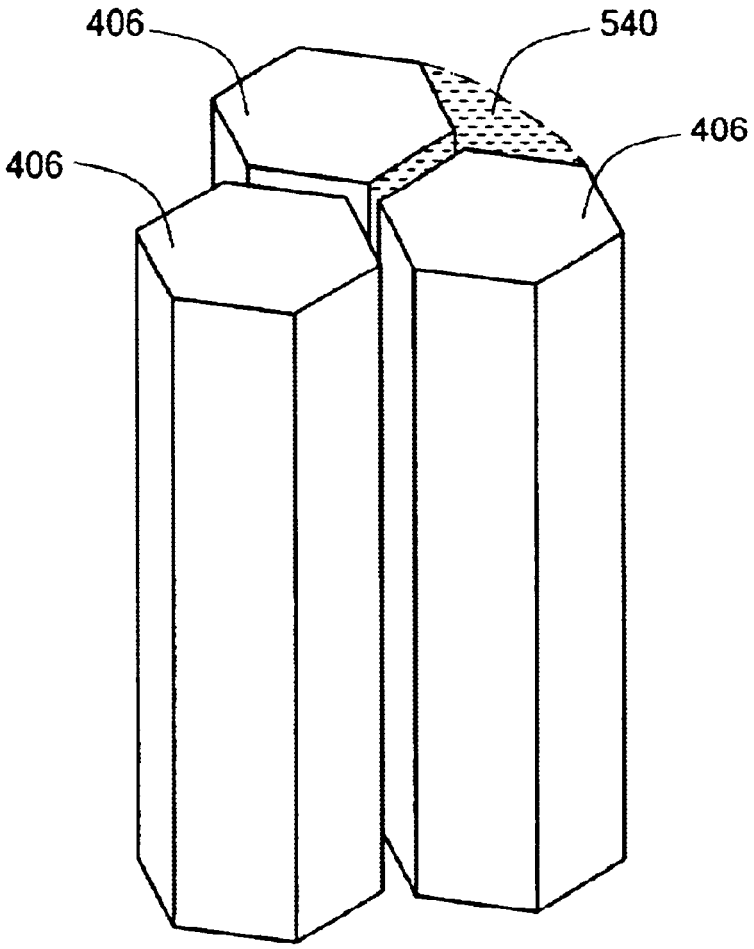
FIG. 36 is a schematic depiction showing the use of a glass filler around individual penetrators in order to lower the deployment angles in accordance with the subject invention.

In some examples, selected rods 406*a*, 406*b*, 406*c*, and 406*d* extend continuously through all the bays to help focus the remaining rods and to reduce the angle of deployment of all the rods. Another idea is to add an encapsulant 540, which fills the voids between the rods 406, FIG. 36. The encapsulant may be glass and/or grease coating each rod. Preferably, there are a plurality of spaced detonators 450*a*, 450*b*, and 450*c*, FIG. 34 for each explosive charge section each detonator typically aligned with a bay 400, 402, and 404, respectively, to provide a flatter explosive front and to further reduce the deployment angles of rods 406. Another initiation technique could be used to reduce edge effects by generating a softer push against the rods. This concept would utilize backward initiation where the multiple detonators 450*a*′, 450*b*′, and 450*c*′are moved from their traditional location on the outer explosive to the inner base proximate buffer 500. The explosive initiators are inserted at the explosive/foam interface which generates a flat shock wave traveling away from the rod core. This initiation logic generates a softer push against the rod core reducing all lateral edge effects.

Figure 37:
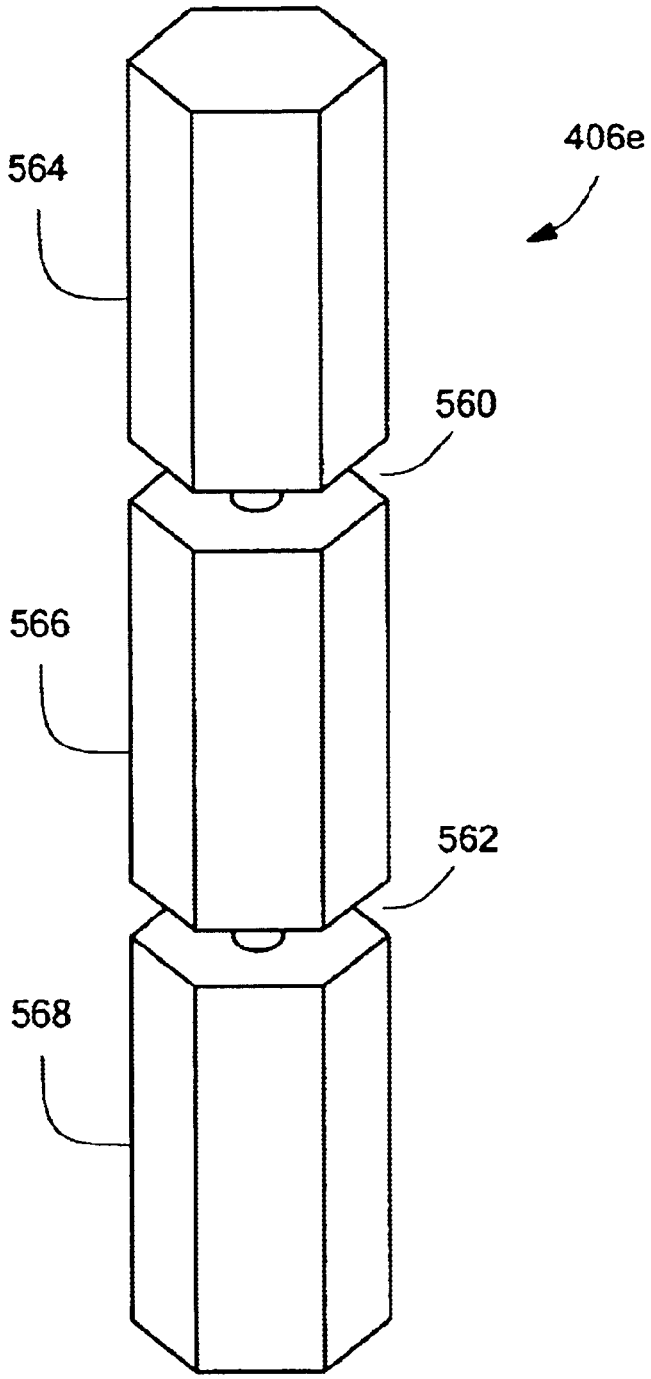
FIG. 37 is a schematic three-dimensional view showing a different type of projectile in accordance with the subject invention including two fragable portions.

Another idea is to use rod 406*e*, FIG. 37 at select locations or even for all the rods. Rod 406*e* extends through all the bays but includes frangible portions of reduced diameter 560 and 562 at the intersection of the bays, which break upon deployment dividing rod 406*e* into three separate portions 564, 566, and 568.

The result with all, a select few, or even just one of these exemplary structural means for reducing the deployment angles of the rods or projectiles when the detonator(s) detonate the explosive charge sections is a tighter, more focused rod spray pattern. Also, the means for aligning the projectiles discussed above with reference to FIGS. 6–11 and/or the means for aiming the projectiles discussed above with reference to FIGS. 12–15 maybe incorporated with the warhead configuration shown in FIGS. 34–35 in accordance with this invention.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A kinetic energy rod warhead with lower deployment angles comprising:

a projectile core including a plurality of individual projectiles;

an explosive charge about the core;

at least one detonator for the explosive charge; and means for reducing the deployment angles of the projectiles when the detonator detonates the explosive charge.

2. The warhead of claim 1 in which the means for reducing the deployment angles includes a buffer between the explosive charge and the core.

3. The warhead of claim 2 in which the buffer is a poly foam material.

4. The warhead of claim 2 in which the buffer extends beyond the core.

5. The warhead of claim 2 in which the means for reducing includes multiple space detonators located proximate the buffer.

6. The warhead of claim 1 further including an end plate on each side of the projectile core.

7. The warhead of claim 6 in which each end plate is made of steel or aluminum.

8. The warhead of claim 6 in which the means for reducing includes an absorbing layer between each end plate and the core.

9. The warhead of claim 8 in which the absorbing layer is made of aluminum.

10. The warhead of claim 8 in which the means for reducing includes a buffer between the absorbing layer and the core.

11. The warhead of claim 10 in which the buffer is a layer of poly foam.

12. The warhead of claim 6 in which the means for reducing includes a momentum trap on each end plate.

13. The warhead of claim 12 in which the momentum trap is a thin layer of glass applied to the end plates.

14. The warhead of claim 1 in which the core includes a plurality of bays of projectiles.

15. The warhead of claim 14 in which the means for reducing includes a buffer disk between each bay.

16. The warhead of claim 14 in which there are three bays of projectiles.

17. The warhead of claim 14 in which the means for reducing includes selected projectiles which extend continuously through all the bays.

18. The warhead of claim 14 in which selected projectiles extend continuously through each bay with frangible portions located at the intersection between two adjacent bays.

19. The warhead of claim 1 in which the core includes a binding wrap around the projectiles.

20. The warhead of claim 1 in which the projectile core includes an encapsulant sealing the projectiles together.

21. The warhead of claim 20 in which the encapsulant is glass.

22. The warhead of claim 20 in which the encapsulant is grease.

23. The warhead of claim 20 in which the encapsulant includes grease on each projectile and glass in the spaces between projectiles.

24. The warhead of claim 1 in which the explosive charge is divided into sections.

25. The warhead of claim 24 further including shields between each explosive charge section.

26. The warhead of claim 25 in which the shields are made of composite material.

27. The warhead of claim 26 in which the composite material is steel sandwiched between polycarbonate resin sheet layers.

28. The warhead of claim 24 in which each explosive charge section is wedged-shaped having a proximal surface abutting the projectile core and a distal surface.

29. The warhead of claim 28 in which the distal surface is tapered to reduce weight.

30. The warhead of claim 1 in which the projectiles have a hexagon shape.

31. The warhead of claim 1 in which the projectiles are made of tungsten.

32. The warhead of claim 1 in which the projectiles have a cylindrical cross section.

33. The warhead of claim 1 in which the projectiles have a non-cylindrical cross section.

34. The warhead of claim 1 in which the projectiles have a star-shaped cross section.

35. The warhead of claim 1 in which the projectiles have a cruciform cross section.

36. The warhead of claim 1 in which the projectiles have flat ends.

37. The warhead of claim 1 in which the projectiles have a non-flat nose.

38. The warhead of claim 1 in which the projectiles have a pointed nose.

39. The warhead of claim 1 in which the projectiles have a wedge-shaped nose.

40. The warhead of claim 1 further including means for aligning the individual projectiles when the explosive charge deploys the projectiles.

41. The warhead of claim 40 in which the means for aligning includes a plurality of detonators space along the explosive charge configured to prevent sweeping shock waves at the interface of the projectile core and the explosive charge to prevent tumblings of the projectiles.

42. The warhead of claim 40 in which the means for aligning includes a body in the core with orifices therein, the projectiles disposed in the orifices of the body.

43. The warhead of claim 42 in which the body is made of low density material.

44. The warhead of claim 40 in which the means for aligning includes a flux compression generator which generates a magnetic alignment field to align the projectiles.

45. The warhead of claim 44 in which there are two flux compression generators, one on each end of the projectile core.

46. The warhead of claim 45 in which each flux compression generator includes a magnetic core element, a number of coils about the magnetic core element, and an explosive for the imploding the magnetic core element.

47. A kinetic energy rod warhead with lower deployment angles comprising:

a projectile core including a plurality of bays of individual projectiles;

an explosive charge about the core divided into sections;

shields between each explosive charge section;

at least one detonator associated with selected explosive charge sections for aiming the projectiles in a predetermine primary firing direction;

an end plate on each side of the projectile core; and a buffer between the explosive charge and the core to reduce the deployment angles of the projectiles when the detonators detonate the explosive charge.

48. The warhead of claim 47 in which the buffer is a poly foam material.

49. The warhead of claim 48 in which the buffer extends beyond the core.

50. The warhead of claim 47 further including multiple spaced detonators located proximate the buffer.

51. The warhead of claim 47 in which each end plate is made of steel or aluminum.

52. The warhead of claim 47 further including an absorbing layer between each end plate and the core.

53. The warhead of claim 52 in which the absorbing layer is made of aluminum.

54. The warhead of claim 52 further including a buffer between the absorbing layer and the core.

55. The warhead of claim 54 in which the buffer is a layer of poly foam.

56. The warhead of claim 47 further including a momentum trap on each end plate.

57. The warhead of claim 56 in which the momentum trap is a thin layer of glass applied to the end plates.

58. The warhead of claim 47 further including a buffer disk between adjacent bays.

59. The warhead of claim 47 in which there are three bays of projectiles.

60. The warhead of claim 47 further including selected projectiles which extend continuously through all the bays.

61. The warhead of claim 60 in which selected projectiles extend continuously through each bay with frangible portions at the intersection between two adjacent bays.

62. The warhead of claim 47 in which each bay includes a binding wrap around the projectiles.

63. The warhead of claim 47 in which the projectile core includes an encapsulant sealing the projectiles together.

64. The warhead of claim 63 in which the encapsulant is glass.

65. The warhead of claim 63 in which the encapsulant is grease.

66. The warhead of claim 63 in which the encapsulant includes grease on each projectile and glass in the spaces between projectiles.

67. The warhead of claim 47 in which the shields are made of composite material.

68. The warhead of claim 67 in which the composite material is steel sandwiched between polycarbonate resin sheets layers.

69. The warhead of claim 47 in which each explosive charge section is wedged-shape having a proximal surface abutting the projectile core and a distal surface.

70. The warhead of claim 69 in which the distal surface is tapered to reduce weight.

71. The warhead of claim 47 in which the projectiles are hexagon shaped.

72. The warhead of claim 47 in which the projectiles are made of tungsten.

73. A warhead of claim 47 in which the projectiles have a cylindrical cross section.

74. The warhead of claim 47 in which the projectiles have a non-cylindrical cross section.

75. The warhead of claim 47 in which the projectiles have a star-shaped cross section.

76. The warhead of claim 47 in which the projectiles have a cruciform cross section.

77. The warhead of claim 47 in which the projectiles have flat ends.

78. The warhead of claim 47 in which the projectiles have a non-flat nose.

79. The warhead of claim 47 in which the projectiles have a pointed nose.

80. The warhead of claim 47 in which the projectiles have a wedge-shaped nose.

81. The warhead of claim 47 further including means for aligning the individual projectiles when the explosive charge deploys the projectiles.

82. The warhead of claim 81 in which the means for aligning includes a plurality of detonators spaced along the explosive charge configured to prevent sweeping shock waves at the interface of the projectile core and the explosive charge to prevent tumbling of the projectiles.

83. The warhead of claim 81 in which the means for aligning includes a body in the core with orifices therein, the projectiles disposed in the orifices of the body.

84. The warhead of claim 83 in which the body is made of a low density material.

85. The warhead of claim 81 in which the means for aligning includes a flux compression generator which generates a magnetic alignment field to align the projectiles.

86. The warhead of claim 85 in which there are two flux compression generators, one on each end of the projectile core.

87. The warhead of claim 86 in which each flux compression generator includes a magnetic core element, a number of coils about the magnetic core element, and an explosive for the imploding the magnetic core element.

88. A kinetic energy rod warhead comprising:

a projectile core including a plurality of bays of individual projectiles;

an explosive charge about the core divided into sections;

shields between each explosive charge section;

a plurality of spaced detonators associated with selected explosive charge sections;

an end plate on each end of the projectile core;

a buffer between the explosive charge and the core extending beyond the core; and a buffer between each projectile bay.

89. The warhead of claim 88 in which each detonator is aligned with a projectile bay.

90. The warhead of claim 88 further including an absorbing layer between each end plate and the core.

91. The warhead of claim 88 further including a momentum trap on each end plate.

92. The warhead of claim 88 in which the detonators are located proximate the buffer.

* * * * *